US009235164B2

(12) United States Patent
Ichikawa et al.

(10) Patent No.: US 9,235,164 B2
(45) Date of Patent: Jan. 12, 2016

(54) TRANSFER DEVICE AND IMAGE FORMING APPARATUS INCLUDING SAME

(71) Applicants: Junichi Ichikawa, Kanagawa (JP); Seiichi Kogure, Kanagawa (JP); Junpei Fujita, Kanagawa (JP); Kazuki Yogosawa, Tokyo (JP); Kenji Sugiura, Kanagawa (JP)

(72) Inventors: Junichi Ichikawa, Kanagawa (JP); Seiichi Kogure, Kanagawa (JP); Junpei Fujita, Kanagawa (JP); Kazuki Yogosawa, Tokyo (JP); Kenji Sugiura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/185,242

(22) Filed: Feb. 20, 2014

(65) Prior Publication Data

US 2014/0241744 A1 Aug. 28, 2014

(30) Foreign Application Priority Data

Feb. 26, 2013 (JP) ..... 2013-036072
Jun. 4, 2013 (JP) ..... 2013-118100

(51) Int. Cl.
*G03G 15/16* (2006.01)

(52) U.S. Cl.
CPC ..... *G03G 15/1605* (2013.01); *G03G 15/1615* (2013.01); *G03G 2215/0129* (2013.01)

(58) Field of Classification Search
CPC ..... G03G 15/161; G03G 15/1615; G03G 2215/1614; G03G 2215/1623
USPC ..... 399/66, 302, 308
See application file for complete search history.

(56) References Cited

U.S. PATENT DOCUMENTS

2005/0214037 A1* 9/2005 Kishi ..... 399/302
2010/0142985 A1 6/2010 Minbe et al.
2010/0221029 A1 9/2010 Minbu et al.
2011/0064487 A1 3/2011 Ichihashi et al.

(Continued)

FOREIGN PATENT DOCUMENTS

JP 2001005311 A * 1/2001
JP 2003-248388 9/2003
JP 2006-039401 2/2006

(Continued)

OTHER PUBLICATIONS

Machine Translation of JP 2001005311 A obtained on Dec. 29, 2014.*

(Continued)

*Primary Examiner* — Gregory H Curran
(74) *Attorney, Agent, or Firm* — Oblon, McClelland, Maier & Neustadt, L.L.P.

(57) ABSTRACT

A transfer device includes a nip forming member to contact a surface of an image bearing member to form a transfer nip therebetween, a pressing device, and a nip pressure changing device. The pressing device includes a plurality of elastic members, to produce a contact pressure between the nip forming member and the image bearing member according to a restoring force of at least one of the elastic members upon deformation of the elastic member. The nip pressure changing device changes an amount of elastic deformation of the elastic member between at least two stages to change a nip pressure of the transfer nip. While the contact pressure is produced by one of the elastic members, the nip pressure changing device changes the amount of elastic deformation of a different elastic member, different from the one that produces the contact pressure, to change the nip pressure of the transfer nip.

26 Claims, 12 Drawing Sheets

(56) References Cited

U.S. PATENT DOCUMENTS

| | | | |
|---|---|---|---|
| 2011/0158690 | A1 | 6/2011 | Mimbu et al. |
| 2011/0293312 | A1 | 12/2011 | Mimbu et al. |

FOREIGN PATENT DOCUMENTS

| | | | |
|---|---|---|---|
| JP | 2009-237468 | | 10/2009 |
| JP | 2010-048915 | A | 3/2010 |
| JP | 2012-037720 | | 2/2012 |
| JP | 2012-042748 | | 3/2012 |
| JP | 2012-108545 | | 6/2012 |
| JP | 2012-128229 | | 7/2012 |

OTHER PUBLICATIONS

U.S. Appl. No. 14/018,525, filed Sep. 5, 2013.

* cited by examiner

FIG. 4

| ITEM | DETAIL |
|---|---|
| MACHINE | imagio MP C7501 |
| PROCESS LINEAR SPEED | 282 mm/sec |
| INTERMEDIATE TRANSFER BELT | PI Belt, Elastic belt |
| CONTACT PRESSURE OF TRANSFER ROLLER | 60N, 120N, 240N |
| PAPER | a) LEATHAC 100 kg-paper,<br>LEATHAC 175 kg-paper,<br>LEATHAC 260 kg-paper<br>b) OK Top-coat 79.1 gsm-paper |
| ENVIRONMENT | 23 deg.C / 50% RH |
| IMAGE | a) 70 mm × 55 mm black, solid image<br>b) 70 mm × 55 mm 2-dot image |
| EVALUATION PARAMETERS | a) Reproducibility of density at recessed portion<br>b) Reproducibility of dot |

FIG. 5

| | |
|---|---|
| GOOD | Image density at both recessed and projecting portions graded as 4 or above |
| FAIR | Image density at only one of the recessed portion and the projecting portion graded as 3 or below |
| POOR | Image density at both recessed and projecting portions graded as 3 or below |

FIG. 6

| | |
|---|---|
| Grade 5 | Recessed portions are covered with toner completely |
| Grade 4 | Recessed portions are covered with toner almost completely, but the sheet portion can be slightly seen at the recessed portions having a relatively deep depth |
| Grade 3 | The sheet portions are clearly seen at the recessed portions having a relatively deep depth. |
| Grade 2 | Worse than Grade 3, but better than Grade 1 |
| Grade 1 | Toner is not adhered to the recessed portions at all |

FIG. 7

| | |
|---|---|
| GOOD | The shape of dots on the sheet is almost the same as the dots on the transfer belt |
| POOR | The shape of dots on the sheet varies more than the dots on the transfer belt, and dots are connected |

| | | PI | | | ELASTIC BELT | | |
|---|---|---|---|---|---|---|---|
| | | 60N | 120N | 240N | 60N | 120N | 240N |
| DENSITY REPRODUCIBILITY AT RECESSED PORTION | LEATHAC 100 kg-paper | POOR | POOR | POOR | GOOD | GOOD | GOOD |
| | LEATHAC 175 kg-paper | POOR | POOR | POOR | FAIR | GOOD | GOOD |
| | LEATHAC 260 kg-paper | POOR | POOR | POOR | POOR | FAIR | GOOD |
| DOT REPRODUCIBILITY | OK Top-coat 79.1 gsm-paper | (GOOD) | (GOOD) | (GOOD) | GOOD | POOR | POOR |

TRANSFER DEVICE AND IMAGE FORMING APPARATUS INCLUDING SAME

CROSS-REFERENCE TO RELATED APPLICATIONS

This patent application is based on and claims priority pursuant to 35 U.S.C. §119 from Japanese Patent Application Nos. 2013-036072, filed on Feb. 26, 2013, and 2013-118100, filed on Jun. 4, 2013, both in the Japan Patent Office, which are hereby incorporated herein by reference in their entirety.

BACKGROUND

1. Technical Field

Exemplary aspects of the present disclosure generally relate to a transfer device and an image forming apparatus, such as a copier, a facsimile machine, a printer, or a multi-functional system including a combination thereof, and more particularly, to a transfer device that transfers a toner image borne on an image bearing member onto a recording material and an image forming apparatus including the transfer device.

2. Description of the Related Art

A known image forming apparatus such as disclosed in JP-4040611-B1 (JP-2006-39401-A) forms a charged latent image on a surface of an image bearing member such as a photosensitive drum by writing optically an image based on image information on the uniformly charged image bearing member. The latent image is developed with a developing device with toner to form a visible image, known as a toner image. Subsequently, the toner image is transferred onto a recording sheet (recording material), and is fixed thereon.

In the image forming apparatus of this kind, the toner image is formed on the photosensitive drum through a known electrophotographic process. In the known process, an n intermediate transfer belt formed into an endless loop serving also as an image bearing member contacts the photosensitive drum to form a so-called primary transfer nip therebetween. In the primary transfer nip, the toner image on the photosensitive drum is primarily transferred onto the intermediate transfer belt. A secondary transfer roller serving as a nip forming member contacts the intermediate transfer belt to form a so-called secondary transfer nip. A secondary-transfer opposing roller is disposed inside the looped intermediate transfer belt opposite the secondary transfer roller with the intermediate transfer belt interposed therebetween.

While the secondary-transfer opposed roller disposed inside the loop of the intermediate transfer belt is grounded, the secondary transfer roller disposed outside the loop is supplied with a secondary transfer bias (voltage). With this configuration, a secondary transfer electric field is formed between the secondary-transfer opposing roller and the secondary transfer roller so that the toner image moves electrostatically from the secondary-transfer opposing roller side to the secondary transfer roller side. A recording medium is fed to the secondary transfer nip in appropriate timing such that the recording medium is aligned with the toner image formed on the intermediate transfer belt. Due to the secondary transfer electric field and a nip pressure in the secondary transfer nip, the toner image on the intermediate transfer belt is secondarily transferred onto the recording medium.

In recent years, a variety of recording media such Japanese paper known as "Washi" have come on market. Such recording media have a coarse surface through embossing process. A pattern of light and dark patches according to the surface condition of the recording medium appears in an output image. Toner does not transfer well to such embossed surfaces, in particular, the recessed portions of the surface. This inadequate transfer of the toner appears as a pattern of light and dark patches in the resulting output image.

In the known image forming apparatus, the intermediate transfer belt employs an elastic intermediate transfer belt in which an elastic layer made of urethane rubber and silicone rubber is formed on the base layer of the intermediate transfer belt and fluororesin or the like is used for the surface layer thereof. Such an intermediate transfer belt allows the elastic layer thereof to deform in the belt thickness direction due to the pressure of the secondary transfer nip when transferring the toner image from the intermediate transfer belt onto the recording sheet having a rough surface. Accordingly, the surface of the intermediate transfer belt and the recording sheet, between which the toner is interposed, contact well, thereby transferring reliably the toner image onto the recording sheet.

JP-2012-128229-A also discloses an image forming apparatus including an elastic intermediate transfer belt having an elastic layer. The image forming apparatus includes a pressing mechanism which can change a pressing force of the secondary transfer roller relative to the intermediate transfer belt. The pressure of the secondary transfer nip is increased when forming an image on a recording material with high surface roughness such as fabric. The pressure of the secondary transfer nip is decreased when forming an image onto a recording sheet with low surface roughness such as a gloss resin sheet. With this configuration, for each of a wide variety of recording sheets, secondary transfer is performed at an optimum secondary transfer nip pressure to obtain satisfactory transfer efficiency.

As disclosed in JP-2012-128229-A, in a case in which the elastic intermediate transfer belt is used, it is desirable that the secondary transfer be performed at a suitable secondary transfer nip pressure depending on types of recording sheets with different surface unevenness to obtain satisfactory transferability. However, as the number of types of corresponding recording sheets is increased, a change width of the secondary transfer nip pressure is widened. Therefore, the range of the secondary transfer nip pressure changeable in the known pressing mechanism is difficult to accommodate the necessary change width of the secondary transfer nip pressure. For example, in the pressing mechanism such as in JP-2012-128229-A, the pressing force of the secondary transfer roller is changed from 50 [N] to 75 [N], but the change width is insufficient.

More specifically, in the known pressing mechanism capable of changing the secondary transfer nip pressure, generally, the pressing force of the secondary transfer roller against the intermediate transfer belt is changed by changing the compression amount and the tension of springs such as a compression spring and a tension spring. In this configuration, when the secondary transfer nip pressure is changed significantly, a significant change in the compression amount and the tension of the springs is necessary. Therefore, the springs which can change significantly the compression amount and the tension, in other words, springs (elastic members) having a wide elastically deformable range are necessary. However, manufacturing such spring members is not easy and increases the manufacturing cost. It is thus difficult to obtain the necessary change width of the secondary transfer nip pressure.

By contrast, when using a spring (elastic member) having a relatively high spring constant (modulus of elasticity), a spring having a relatively narrow, elastically deformable range may be used even when the secondary transfer nip pressure is changed significantly. However, in the spring having a high spring constant, the rate of change of the restoring force with respect to the unit compression amount or the unit tension amount is too high. Consequently, the sensitivity of the secondary transfer nip pressure with respect to the compression amount or the tension amount (elastic deformation amount) of the spring member is increased.

The secondary transfer nip pressure thus easily deviates from the target value due to the slight deviation and error of the compression amount and the tension amount of the spring so that it is difficult to reliably obtain the target secondary transfer nip pressure. The increase in the spring constant (modulus of elasticity) is thus limited. In the known configuration which requires the spring (elastic member) having a wide elastically deformable range, it is difficult to obtain the necessary change width of the secondary transfer nip pressure.

The similar difficulty may arise in an image forming apparatus in which a significant change in the transfer nip pressure is required.

In view of the above, there is demand for a transfer device capable of reliably obtaining a target transfer nip pressure using an elastic member with a relatively narrow elastic deformation range in the case of changing a transfer nip pressure, and an image forming apparatus including the transfer device.

SUMMARY

In view of the foregoing, in an aspect of this disclosure, there is provided a novel transfer device including a nip forming member, a pressing device, and a nip pressure changing device. The nip forming member contacts a surface of an image bearing member to form a transfer nip therebetween. The pressing device includes a plurality of elastic members, to produce a contact pressure between the nip forming member and the image bearing member according to a restoring force of at least one of the elastic members upon deformation of the elastic member. The nip pressure changing device changes an amount of elastic deformation of the elastic member between at least two stages to change a nip pressure of the transfer nip. While the contact pressure is produced by one of the elastic members, the nip pressure changing device changes the amount of elastic deformation of a different elastic member, different from the one that produces the contact pressure, to change the nip pressure of the transfer nip.

According to another aspect, an image forming apparatus includes the transfer device.

The aforementioned and other aspects, features and advantages would be more fully apparent from the following detailed description of illustrative embodiments, the accompanying drawings and the associated claims.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein:

FIG. 4 is a table showing experiment conditions of experiments performed by the present inventors;

FIG. 5 is a table showing evaluation parameters of density reproducibility at a recessed portion;

FIG. 6 is a table showing requirements for grades of density reproducibility at the recessed portion;

FIG. 7 is a table showing evaluation parameters of dot reproducibility;

FIG. 8 (*b*) shows an unfixed dot image on a smooth sheet evaluated as GOOD;

FIG. 8 (*c*) shows an unfixed dot image on the smooth sheet evaluated as POOR;

DETAILED DESCRIPTION

Figure 1:
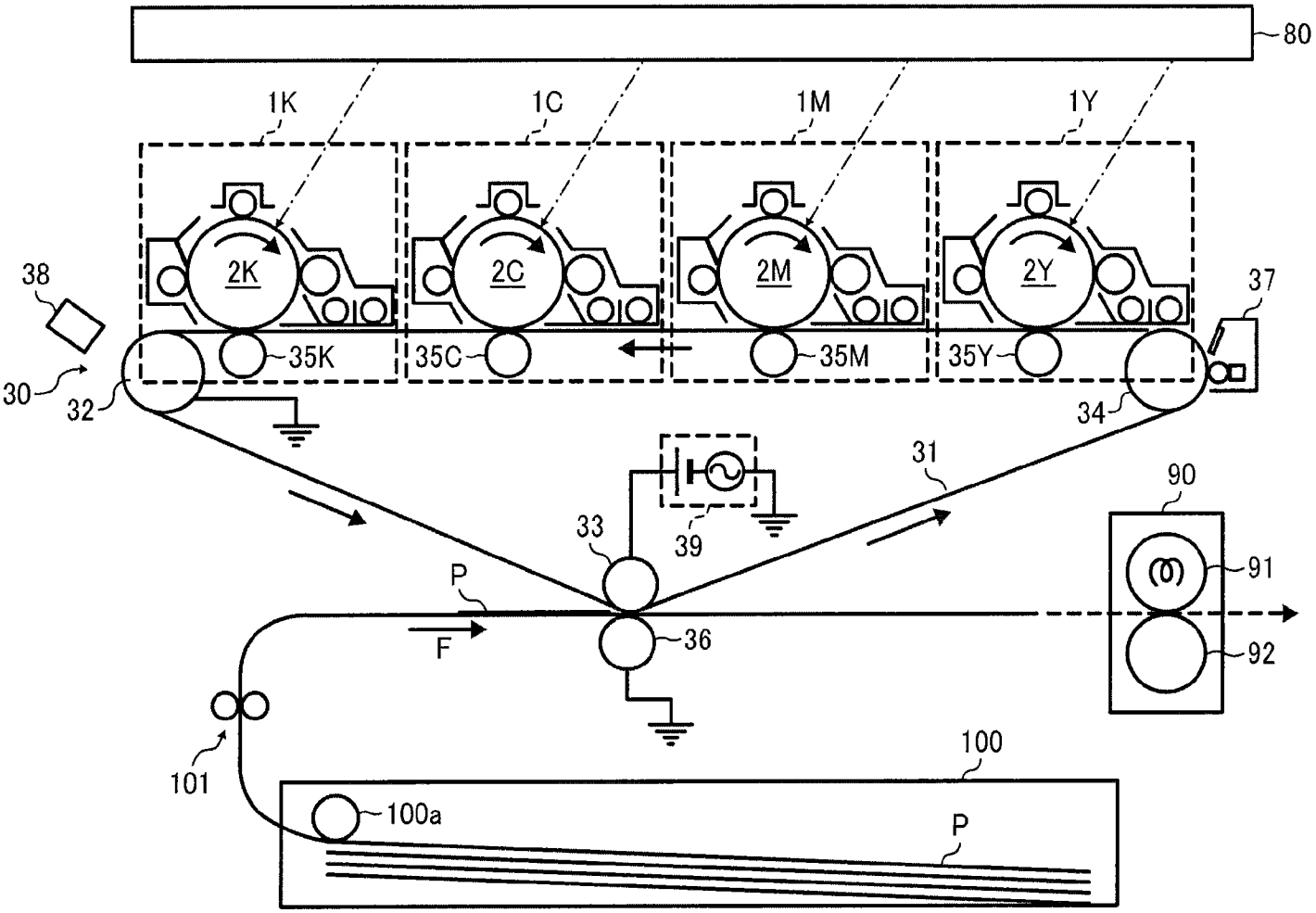
FIG. 1 is a schematic diagram illustrating a printer as an example of an image forming apparatus according to an illustrative embodiment of the present disclosure.

A description is now given of illustrative embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of this disclosure.

In addition, it should be noted that the terminology used herein is for the purpose of describing particular embodiments only and is not intended to be limiting of this disclosure. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but include other printable media as well.

Referring now to the drawings, wherein like reference numerals designate identical or corresponding parts throughout the several views, exemplary embodiments of the present patent application are described.

With reference to FIG. 1, a description is provided of an electrophotographic color printer as an example of an image forming apparatus according to an illustrative embodiment of the present disclosure.

FIG. 1 is a schematic diagram illustrating the image forming apparatus. As illustrated in FIG. 1, the image forming apparatus includes four image forming units 1Y, 1M, 1C, and 1K for forming toner images, one for each of the colors yellow, magenta, cyan, and black, respectively, a transfer unit 30, an optical writing unit 80, a fixing device 90, a sheet cassette 100, a pair of registration rollers 101, and so forth. It is to be noted that the suffixes Y, M, C, and K denote colors yellow, magenta, cyan, and black, respectively. To simplify the description, these suffixes Y, M, C, and K indicating colors are omitted herein, unless otherwise specified.

The image forming units 1Y, 1M, 1C, and 1K all have the same configuration as all the others, differing only in the color of toner employed. Thus, a description is provided of the image forming unit 1K for forming a toner image of black as a representative example of the image forming units 1. The image forming units 1Y, 1M, 1C, and 1K are replaced upon reaching their product life cycles.

Figure 2:
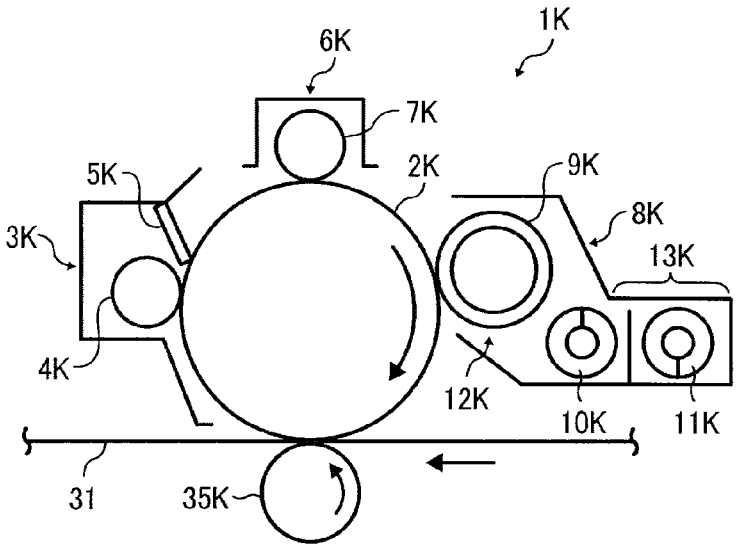
FIG. 2 is an enlarged schematic diagram illustrating an image forming unit for black as an example of image forming units employed in the image forming apparatus of FIG. 1.

With reference to FIG. 2, a description is provided of the image forming unit 1K as an example of the image forming units. FIG. 2 is a schematic diagram illustrating the image forming unit 1K. The image forming unit 1K includes a photosensitive drum 2K serving as a latent image bearing member. The photosensitive drum 2K is surrounded by various pieces of imaging equipment, such as a charging device 6K, a developing device 8K, a drum cleaning device 3K, and a charge remover. These devices are held in a common holder so that they can be detachably attachable and replaced at the same time.

The photosensitive drum 2K comprises a drum-shaped base on which an organic photosensitive layer is disposed, with the external diameter of approximately 60 mm. The photosensitive drum 2K is rotated in a clockwise direction by a driving device. The charging device 6K includes a charging roller 7K supplied with a charging bias. The charging roller 7K contacts or approaches the photosensitive drum 2K to generate an electrical discharge therebetween, thereby charging uniformly the surface of the photosensitive drum 2K.

According to the present illustrative embodiment, the photosensitive drum 11 is uniformly charged with a negative polarity which is the same polarity as the normal charge on toner. As the charging bias, an alternating current (AC) voltage superimposed on a direct current (DC) voltage is employed. The charging roller 7K comprises a metal cored bar coated with a conductive elastic layer made of a conductive elastic material. According to the present illustrative embodiment, the photosensitive drum 2K is charged by a charger or the charging roller 7K contacting the photosensitive drum 2K or disposed near the photosensitive drum 2K. Alternatively, a corona charger may be employed.

The uniformly charged surface of the photosensitive drum 2K is scanned by a light beam projected from the optical writing unit 80, thereby forming an electrostatic latent image for the color black on the surface of the photosensitive drum 2K. The electrostatic latent image for the color black on the photosensitive drum 2K is developed with black toner by the developing device 8K. Accordingly, a visible image, also known as a toner image of black, is formed. As will be described later in detail, the toner image is transferred primarily onto an intermediate transfer belt 31.

The drum cleaning device 3K removes residual toner remaining on the surface of the photosensitive drum 2K after a primary transfer process, that is, after the photosensitive drum 2K passes through a primary transfer nip. The drum cleaning device 3K includes a brush roller 4K and a cleaning blade 5K. The cleaning blade 5K is cantilevered, that is, one end of the cleaning blade 5K is fixed to the housing of the drum cleaning device 3K, and its free end contacts the surface of the photosensitive drum 2K. The brush roller 4K rotates and brushes off the residual toner from the surface of the photosensitive drum 2K while the cleaning blade 5K removes the residual toner by scraping. It is to be noted that the cantilevered end of the cleaning blade 5K is positioned downstream from its free end contacting the photosensitive drum 2K in the direction of rotation of the photosensitive drum 2K so that the free end of the cleaning blade 5K faces or becomes counter to the direction of rotation.

The charge remover removes residual charge remaining on the photosensitive drum 2K after the surface thereof is cleaned by the drum cleaning device 3K in preparation for the subsequent imaging cycle. The surface of the photosensitive drum 2K is initialized.

The developing device 8K includes a developing section 12K and a developer conveyer 13K. The developing section 12K includes a developing roller 9K inside thereof. The developer conveyer 13K mixes a developing agent for the color black and transports the developing agent. The developer conveyer 13K includes a first chamber equipped with a first screw 10K and a second chamber equipped with a second screw 11K. The first screw 10K and the second screw 11K are each constituted of a rotatable shaft and helical flighting wrapped around the circumferential surface of the shaft. Each end of the shaft of the first screw 10K and the second screw 11K in the axial direction is rotatably held by a shaft bearing.

The first chamber with the first screw 10K and the second chamber with the second screw 11K are separated by a wall, but each end of the wall in the direction of the screw shaft has a connecting hole through which the first chamber and the second chamber are connected. The first screw 10K mixes the developing agent by rotating the helical flighting and carries the developing agent from the distal end to the proximal end of the screw in the direction perpendicular to the surface of the recording medium while rotating. The first screw 10K is disposed parallel to and facing the developing roller 9K. Hence, the developing agent is delivered along the axial (shaft) direction of the developing roller 9K. The first screw 10K supplies the developing agent to the surface of the developing roller 9K along the direction of the shaft line of the developing roller 9K.

The developing agent transported near the proximal end of the first screw 10K in FIG. 2 passes through the connecting hole in the wall near the proximal side and enters the second chamber. Subsequently, the developing agent is carried by the helical flighting of the second screw 11K. As the second screw 11K rotates, the developing agent is delivered from the proximal end to the distal end in the drawing while being mixed in the direction of rotation.

In the second chamber, a toner density detector for detecting the density of toner in the developing agent is disposed substantially at the bottom of a casing of the chamber. As the toner density detector, a magnetic permeability detector is employed. There is a correlation between the toner density and the magnetic permeability of the developing agent consisting of toner and a magnetic carrier. Therefore, the magnetic permeability detector can detect the density of the toner.

Although not illustrated, the image forming apparatus includes toner supply devices to supply independently toner of yellow, magenta, cyan, and black to the second chamber of the respective developing devices 8. The controller of the image forming apparatus includes a Random Access Memory (RAM) to store a target output voltage Vtref for output voltages provided by the toner density detectors for yellow, magenta, cyan, and black. If the difference between the output voltages provided by the toner density detectors for yellow, magenta, cyan, and black, and Vtref for each color exceeds a predetermined value, the toner supply devices are driven for a predetermined time period corresponding to the difference to supply toner. Accordingly, the respective color of toner is supplied to the second chamber of the developing device 8K.

The developing roller 9K in the developing section 12K faces the first screw 10K as well as the photosensitive drum 2K through an opening formed in the casing of the developing device 8K. The developing roller 9K comprises a cylindrical developing sleeve made of a non-magnetic pipe which is rotated, and a magnetic roller disposed inside the developing sleeve. The magnetic roller is fixed so as not to rotate together with the developing sleeve. The developing agent supplied from the first screw 10K is carried on the surface of the developing sleeve due to the magnetic force of the magnetic roller. As the developing sleeve rotates, the developing agent is transported to a developing area facing the photosensitive drum 2K.

The developing sleeve is supplied with a developing bias having the same polarity as toner. The developing bias is greater than the bias of the electrostatic latent image on the photosensitive drum 2K, but less than the charging potential of the uniformly charged photosensitive drum 2K. With this configuration, a developing potential that causes the toner on the developing sleeve to move electrostatically to the electrostatic latent image on the photosensitive drum 2K acts between the developing sleeve and the electrostatic latent image on the photosensitive drum 2K. A non-developing potential acts between the developing sleeve and the non-image formation areas of the photosensitive drum 2K, causing the toner on the developing sleeve to move to the sleeve surface. Due to the developing potential and the non-developing potential, the toner on the developing sleeve moves selectively to the electrostatic latent image formed on the photosensitive drum 2K, thereby forming a visible image, known as a toner image, here, a black toner image.

Similar to the image forming unit 1K, toner images of yellow, magenta, and cyan are formed on the photosensitive drums 2Y, 2M, and 2C of the image forming units 1Y, 1M, and 1C, respectively.

The optical writing unit 80 for writing a latent image on the photosensitive drums 2 is disposed above the image forming units 1Y, 1M, 1C, and 1K. Based on image information received from an external device such as a personal computer (PC), the optical writing unit 80 illuminates the photosensitive drums 2Y, 2M, 2C, and 2K with a light beam projected from a laser diode of the optical writing unit 80. Accordingly, the electrostatic latent images of yellow, magenta, cyan, and black are formed on the photosensitive drums 2Y, 2M, 2C, and 2K, respectively. More specifically, the potential of the portion of the charged surface of the photosensitive drum 2 illuminated with the light beam is attenuated. The potential of the illuminated portion of the photosensitive drum 2 is less than the potential of the other area, that is, the background portion (non-image portion), thereby forming the electrostatic latent image on the photosensitive drum 2. The optical writing unit 80 includes a polygon mirror, a plurality of optical lenses, and mirrors. The light beam projected from the laser diode serving as a light source is deflected in a main scanning direction by the polygon mirror rotated by a polygon motor. The deflected light, then, strikes the optical lenses and mirrors, thereby scanning the photosensitive drums 2. Alternatively, the optical writing unit 80 may employ a light source using an LED array including a plurality of LEDs that projects light.

Referring back to FIG. 1, a description is provided of the transfer unit 30. The transfer unit 30 is disposed below the image forming units 1Y, 1M, 1C, and 1K. The transfer unit 30 includes the intermediate transfer belt 31 serving as an image bearing member formed into an endless loop and rotated in the counterclockwise direction. The transfer unit 30 also includes a drive roller 32, a secondary transfer back surface roller 33, a cleaning auxiliary roller 34, four primary transfer rollers 35Y, 35M, 35C, and 35K (which may be referred to collectively as primary transfer rollers 35), a nip forming roller (which may be referred to as a secondary transfer roller) 36, a belt cleaning device 37, an voltage detector 38, and so forth. The primary transfer rollers 35Y, 35M, 35C, and 35K are disposed opposite the photosensitive drums 2Y, 2M, 2C, and 2K, respectively, via the intermediate transfer belt 31.

The intermediate transfer belt 31 is entrained around and stretched taut between the pluralities of rollers. i.e., the drive roller 32, the secondary-transfer back surface roller 33, the cleaning auxiliary roller 34, and the four primary transfer rollers 35Y, 35M, 35C, and 35K (which may be collectively referred to as the primary transfer rollers 35, unless otherwise specified.) The drive roller 32 is rotated in the counterclockwise direction by a motor or the like, and rotation of the drive roller 32 enables the intermediate transfer belt 31 to rotate in the same direction. The intermediate transfer belt 31 has the following characteristics. The intermediate transfer belt 31 has a thickness in a range of from 20 μm to 200 μm, preferably, approximately 60 μm. The volume resistivity thereof is in a range of from 1e6 Ω·cm to 1e12 Ω·cm, preferably, approximately 1e9 Ω·cm. The volume resistivity is measured with an applied voltage of 100V by a high resistivity meter, Hiresta UPMCPHT 45 manufactured by Mitsubishi Chemical Corporation. The intermediate transfer belt 51 is made of resin such as polyimide resin in which carbon is dispersed.

The intermediate transfer belt 31 is interposed between the photosensitive drums 2Y, 2M, 2C, and 2K, and the primary transfer rollers 35Y, 35M, 35C, and 35K. Accordingly, primary transfer nips are formed between the outer peripheral surface and the image bearing surface of the intermediate transfer belt 31 and the photosensitive drums 2Y, 2M, 2C, and 2K that contact the intermediate transfer belt 31. A primary transfer bias is applied to the primary transfer rollers 35Y, 35M, 35C, and 35K by a transfer bias power source, thereby generating a transfer electric field between the toner images on the photosensitive drums 2Y, 2M, 2C, and 2K, and the respective primary transfer rollers 35Y, 35M, 35C, and 35K. The toner image for yellow formed on the photosensitive drum 2Y enters the primary transfer nip as the photosensitive drum 2Y rotates. Subsequently, the toner image of yellow is primarily transferred from the photosensitive drum 2Y to the intermediate transfer belt 31 by the transfer electrical field and the nip pressure. The intermediate transfer belt 31 on which the toner image of yellow has been transferred passes through the primary transfer nips of magenta, cyan, and black. Subsequently, the toner images on the photosensitive drums 2M, 2C, and 2K are superimposed on the yellow toner image which has been transferred on the intermediate transfer belt 31, one atop the other, thereby forming a composite toner image on the intermediate transfer belt 31 in the primary transfer process. Accordingly, a composite toner image, in which the toner images of yellow, magenta, cyan, and black are superimposed on one another, is formed on the surface of the intermediate transfer belt 31 in the primary transfer.

Each of the primary transfer rollers 35Y, 35M, 35C, and 35K is an elastic roller including a metal cored bar on which a conductive sponge layer is fixated. The outer diameter of the primary transfer rollers 35Y, 35M, 35C, and 35K is approximately 16 mm. The diameter of the metal cored bar is approximately 10 mm. The resistance R of the sponge layer is measured such that a metal roller having an outer diameter of 30 mm is pressed against the sponge layer at a load of 10[N] and the current is measured when a voltage of 1000V is supplied to the metal cored bar of the primary transfer roller 35. Accordingly, the resistance R of the sponge layer is obtained using Ohm's law: R=V/I, where V is a voltage, I is a current, and R is a resistance. The obtained resistance R of the sponge layer is approximately 3E7Ω. The primary transfer rollers 35Y, 35M, 35C, and 35K described above are supplied with a constant-current controlled primary transfer bias. According to the illustrative embodiment described above, a roller-type transfer device (here, the primary transfer rollers 35) is used as a primary transfer device. Alternatively, a transfer charger or a brush-type transfer device may be employed as a primary transfer device.

As illustrated in FIG. 1, the nip forming roller 36 of the transfer unit 30 is disposed outside the loop formed by the intermediate transfer belt 31, opposite the secondary-transfer back surface roller 33 which is disposed inside the loop. The intermediate transfer belt 31 is interposed between the secondary-transfer back surface roller 33 and the nip forming roller 36. Accordingly, a secondary transfer nip is formed between the peripheral surface or the image bearing surface of the intermediate transfer belt 31 and the nip forming roller 36 contacting the surface of the intermediate transfer belt 31. The nip forming roller 36 is grounded. By contrast, a secondary transfer bias is applied to the secondary transfer back surface roller 33 by a secondary transfer bias power source 39 serving as a bias output device. With this configuration, a secondary transfer electric field is formed between the secondary-transfer back surface roller 33 and the nip forming roller 36 so that the toner having a negative polarity is transferred electrostatically from the secondary-transfer back surface roller side to the nip forming roller side.

As illustrated in FIG. 1, the sheet cassette 100 storing a stack of recording sheets P is disposed substantially below the transfer unit 30. The sheet cassette 100 is equipped with a sheet feed roller 100*a* to contact a top sheet of the stack of recording sheets P. As the sheet feed roller 100*a* is rotated at a predetermined speed, the sheet feed roller 100*a* picks up the top sheet and feeds it to a sheet passage in the image forming apparatus. Substantially at the end of the sheet passage, the pair of registration rollers 101 is disposed. The pair of registration rollers 101 temporarily stops rotating, immediately after the recording medium P delivered from the sheet cassette 100 is interposed therebetween. The pair of registration rollers 101 starts to rotate again to feed the recording sheet P to the secondary transfer nip in appropriate timing such that the recording sheet P is aligned with the composite toner image formed on the intermediate transfer belt 31 in the secondary transfer nip.

In the secondary transfer nip, the recording sheet P tightly contacts the composite toner image on the intermediate transfer belt 31, and the composite toner image is transferred onto the recording sheet P by the secondary transfer electric field and the nip pressure applied thereto, thereby forming a color image on the surface of the recording sheet P. The recording sheet P on which the composite color toner image is formed passes through the secondary transfer nip and separates from the nip forming roller 36 and the intermediate transfer belt 31 due to the curvature of the rollers.

The secondary-transfer back surface roller 33 has following characteristics. The secondary-transfer back surface roller 33 is formed of a metal cored bar on which a conductive nitrile rubber (NBR) layer is disposed. The outer diameter thereof is approximately 24 mm. The diameter of the metal cored bar of the secondary-transfer back surface roller 33 is approximately 16 mm. The resistance R of the conductive NBR rubber layer is in a range of from 1e6[Ω] to 1e12[Ω], preferably, approximately 4E7[Ω]. The resistance R is measured using the similar or the same method as the primary transfer roller 35 described above.

The nip forming roller 36 has the following characteristics. The nip forming roller 36 comprises a metal cored bar on which a conductive NBR rubber layer is disposed. The outer diameter of the nip forming roller 36 is approximately 24 mm. The diameter of the metal cored bar is approximately 14 mm. The resistance R of the conductive NBR rubber layer is equal to or less than 1E6Ω. The resistance R is measured using the similar or the same method as the primary transfer roller 35 described above.

According to the present illustrative embodiment, the secondary transfer bias power source 39 serving as a secondary transfer bias output device includes a direct current (DC) power source and an alternating current (AC) power source, and an alternating current voltage superimposed on a direct current voltage is output as the secondary transfer bias. An output terminal of the secondary transfer bias power source 39 is connected to the metal cored bar of the nip forming roller 36. The potential of the metal cored bar of the nip forming roller 36 has a similar or the same value as the output voltage output from the secondary transfer bias power source 39. As for the secondary-transfer back surface roller 33, the metal cored bar thereof is grounded. According to the present illustrative embodiment, the nip forming roller 36 is grounded while the superimposed bias is supplied to the metal cored bar of the secondary-transfer back surface roller 33. Alternatively, the secondary-transfer back surface roller 33 may be grounded while the superimposed bias is supplied to the metal cored bar of the nip forming roller 36. In this case, the polarity of the DC voltage is changed. More specifically, as illustrated in FIG. 1, when the superimposed bias is applied to the secondary-transfer back surface roller 33 while the toner has a negative polarity and the nip forming roller 36 is grounded, the DC voltage of the same negative polarity as the toner is used so that a time-averaged potential of the superimposed bias is of the same negative polarity as the toner.

By contrast, in a case in which the secondary-transfer back surface roller 33 is grounded and the superimposed bias is applied to the nip forming roller 36, the DC voltage having the positive polarity opposite that of the toner is used so that the time-averaged potential of the superimposed bias has the positive polarity opposite that of the toner. Instead of applying the superimposed bias to the secondary transfer back surface roller 33 or to the nip forming roller 36, the DC voltage may be supplied to one of the secondary transfer back surface roller 33 and the nip forming roller 36, and the AC voltage may be supplied to the other roller. According to the present illustrative embodiment, an AC voltage having a sine wave is used. Alternatively, an AC voltage having a rectangular wave may be used. When using a sheet of standard paper, such as the one having a relatively smooth surface, a pattern of dark and light according to the surface conditions of the sheet is less likely to appear on the resulting image formed on the recording sheet P. In this case, the transfer bias consisting only of the DC voltage is applied. By contrast, when using a recording sheet having a coarse surface such as pulp paper and embossed paper, the transfer bias needs to be changed from the transfer bias consisting only of the DC voltage to the superimposed bias.

After the intermediate transfer belt 31 passes through the secondary transfer nip, residual toner not having been transferred onto the recording sheet P remains on the intermediate transfer belt 31. The residual toner is removed from the intermediate transfer belt 31 by the belt cleaning device 37 which contacts the surface of the intermediate transfer belt 31. The cleaning auxiliary roller 34 disposed inside the loop formed by the intermediate transfer belt 31 supports the cleaning operation by the belt cleaning device 37.

The voltage detector 38 is disposed outside the loop formed by the intermediate transfer belt 31, opposite the drive roller 32 which is grounded. More specifically, the voltage detector 38 faces a portion of the intermediate transfer belt 31 entrained around the drive roller 32 with a gap of approximately 4 mm. The surface potential of the toner image primarily transferred onto the intermediate transfer belt 31 is measured when the toner image comes to the position opposite the voltage detector 38. According to the present illustrative embodiment, a surface potential sensor EFS-22D manufactured by TDK Corp. is employed as the voltage detector 38.

On the right hand side of the secondary transfer nip between the secondary-transfer back surface roller 53 and the intermediate transfer belt 51, the fixing device 90 is disposed. The fixing device 90 includes a fixing roller 91 and a pressing roller 92. The fixing roller 91 includes a heat source such as a halogen lamp inside thereof. While rotating, the pressing roller 92 pressingly contacts the fixing roller 91, thereby forming a heated area called a fixing nip therebetween. The recording sheet P bearing an unfixed toner image on the surface thereof is delivered to the fixing device 90 and interposed between the fixing roller 91 and the pressing roller 92 in the fixing device 90. Under heat and pressure, the toner adhered to the toner image is softened and fixed to the recording sheet P in the fixing nip. Subsequently, the recording sheet P is discharged outside the image forming apparatus from the fixing device 90 along the sheet passage after fixing.

In the case of monochrome imaging, a support plate supporting the primary transfer rollers 35Y, 35M, and 35C of the transfer unit 30 is moved to separate the primary transfer rollers 35Y, 35M, and 35C from the photosensitive drums 2Y, 2M, and 2C. Accordingly, the outer peripheral surface of the intermediate transfer belt 31, that is, the image bearing surface, is separated from the photosensitive drums 2Y, 2M, and 2C so that the intermediate transfer belt 31 contacts only the photosensitive drum 2K. In this state, the image forming unit 1K is activated to form a toner image of the color black on the photosensitive drum 2K.

Figure 3:
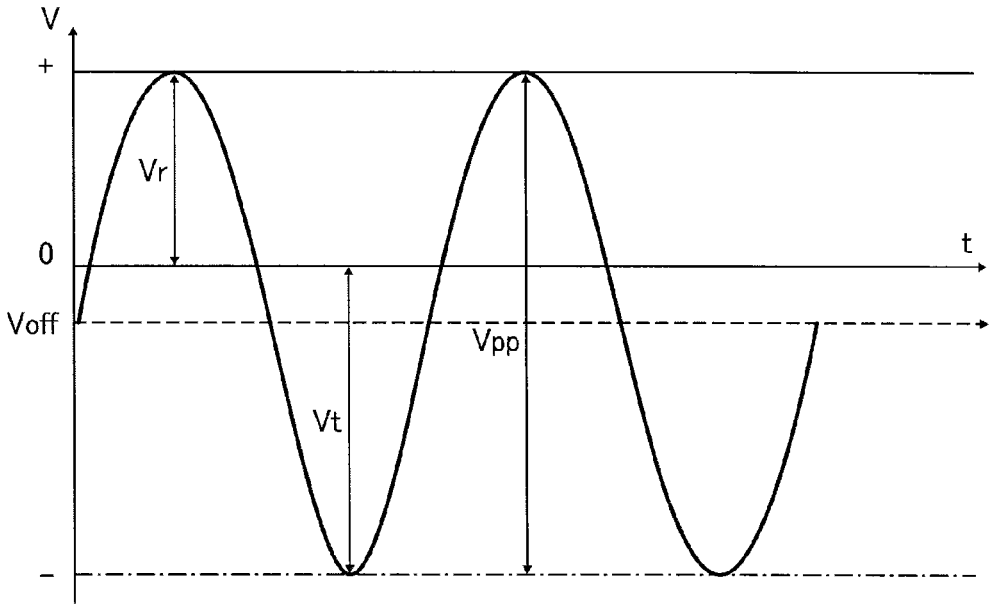
FIG. 3 shows a waveform of a superimposed bias serving as a secondary bias output from a secondary transfer bias power source of the image forming apparatus.

With reference to FIG. 3, a description is provided of the secondary transfer bias. FIG. 3 is a waveform chart showing a waveform of the secondary bias consisting of a superimposed voltage output from the secondary transfer bias power source 39. As described above, according to the illustrative embodiment, the secondary transfer bias is applied to the metal cored bar of the secondary-transfer back surface roller 33. According to the present illustrative embodiment, the secondary transfer bias power source 39 serving as a voltage output device serves as a transfer bias application device that supplies a transfer bias. As described above, when the secondary transfer bias is supplied to the metal cored bar of secondary-transfer back surface roller 33, a potential difference is generated between the metal cored bar of the secondary-transfer back surface roller 33 and the metal cored bar of the nip forming roller 36. In other words, the secondary transfer bias power source 39 serves also as a potential difference generator. In general, a potential difference is treated as an absolute value. However, in this specification, the potential difference is expressed with polarity. More specifically, a value obtained by subtracting the potential of the metal cored bar of the nip forming roller 36 from the potential of the metal cored bar of the secondary-transfer back surface roller 33 is considered as the potential difference.

Using toner having the negative polarity as in the illustrative embodiment, when the polarity of the time-averaged value of the potential difference becomes negative, the potential of the nip forming roller 36 is increased beyond the potential of the secondary-transfer back surface roller 33 towards the opposite polarity side to the polarity of charge on the toner (the positive side in the present embodiment). Accordingly, the toner is electrostatically moved from the secondary-transfer back surface roller side to the nip forming roller side.

In FIG. 3, an offset voltage Voff is a value of the DC component of the secondary transfer bias. A peak-to-peak voltage Vpp is a peak-to-peak voltage of an AC component of the secondary transfer bias. According to the illustrative embodiment, the superimposed bias consists of a superimposed voltage in which the offset voltage Voff and the peak-to-peak voltage Vpp are superimposed. Thus, the time-averaged value of the superimposed bias coincides with the offset voltage Voff. As described above, according to the illustrative embodiment, the secondary transfer bias is applied to the metal cored bar of the secondary-transfer back surface roller 33 while the metal cored bar of the nip forming roller 36 is grounded (0V). Thus, the potential of the metal cored bar of the secondary-transfer back surface roller 33 itself becomes the potential difference between the potentials of the metal cored bar of the secondary-transfer back surface roller 33 and the metal cored bar of the nip forming roller 36. The potential difference between the potentials of the metal cored bar of the secondary-transfer back surface roller 33 and the metal cored bar of the nip forming roller 36 consists of a direct current component (Eoff) having the same value as the offset voltage Voff and an alternating current component (Epp) having the same value as the peak-to-peak voltage (Vpp).

According to the present illustrative embodiment, as illustrated in FIG. 3, the polarity of the offset voltage Voff is negative. According to the present illustrative embodiment, when the polarity of the offset voltage Voff of the secondary transfer bias applied to the secondary-transfer back surface roller 33 is negative, the toner having the negative polarity is repelled by the secondary-transfer back surface roller 33 and relatively drawn to the nip forming roller side. When the polarity of the secondary transfer bias is negative so is the polarity of the toner, the toner of negative polarity is pushed out electrostatically from the secondary-transfer back surface roller side to the nip forming roller side in the secondary transfer nip. Accordingly, the toner on the intermediate transfer belt 31 is transferred onto the recording sheet P.

By contrast, when the polarity of the secondary transfer bias is opposite that of the toner, that is, the polarity of the secondary transfer voltage is positive, the toner having the negative polarity is attracted electrostatically to the secondary-transfer back surface roller side from the nip forming roller side. Consequently, the toner having been transferred to the recording sheet P is attracted again to the intermediate transfer belt 31. It is to be noted that because the time-averaged value of the secondary transfer bias (the same value as the offset voltage Voff in the present embodiment) has the negative polarity, the toner is relatively moved electrostatically from the secondary-transfer back surface roller to the nip forming roller side. In FIG. 3, a return potential peak Vr represents a positive peak value having the polarity opposite that of the toner.

Next, a description is provided of the intermediate transfer belt 31 according to an illustrative embodiment.

The intermediate transfer belt 31 according to the present illustrative embodiment is an endless looped belt having at least a base layer, an elastic layer, and a surface coating layer.

Examples of materials used for the elastic layer of the intermediate transfer belt 31 include, but are not limited to elastic members such as elastic material rubber and elastomer. More specifically, one or more materials selected the following group can be used. The materials include, but are not limited to, butyl rubber, fluorine-based rubber, acrylic rubber, Ethylene Propylene Diene Monomer (EPDM), NBR, acrylonitrile-butadiene-styrene rubber, natural rubber, isoprene rubber, styrene-butadiene rubber, butadiene rubber, urethane rubber, syndiotactic 1, 2-polybutadiene, epichlorohydrin-based rubber, polysulfide rubber, polynorbornene rubber, thermoplastic elastomers (e.g., polystyrene-based, polyolefin-based, polyvinyl chloride-based, polyurethane-based, polyamide-based, polyurea-based, polyester-based, and fluororesin-based thermoplastic elastomers) and the like can be used. However, the materials for the elastic layer of the intermediate transfer belt 31 is not limited thereto.

The thickness of the elastic layer is preferably in a range of from 0.07 mm to 0.5 mm depending on the hardness and the layer structure of the elastic layer. More preferably, the thickness of the elastic layer is in a range of from 0.25 mm to 0.5 mm. When the thickness of the intermediate transfer belt 31 is small such as 0.07 [mm] or less, the pressure to the toner on the intermediate transfer belt 31 increases in the secondary transfer nip portion, and image defects such as toner dropouts occur easily during transfer. Consequently, the transferability of the toner is degraded.

Preferably, the hardness of the elastic layer is $10° \leq HS \leq 65°$ (JIS-A). The optimum hardness is different according to the layer thickness of the intermediate transfer belt 31. When the hardness is lower than 10° JIS-A, image defects such as toner dropouts occur easily during transfer. By contrast, when the hardness is higher than 65° JIS-A, the belt is difficult to entrain around the rollers. Furthermore, the durability of such a belt with the hardness higher than 65° JIS-A is poor because the belt is stretched taught for an extended period of time, causing frequent replacement of the belt.

The base layer of the intermediate transfer belt 31 is formed of relatively inelastic resin. More specifically, one or more materials selected from the following materials can be used. These materials include, but are not limited to polycarbonate, fluorocarbon resin (such as ETFE and PVDF), styrene-based resins (homopolymers and copolymers of styrene or styrene derivatives) such as polystyrene, chloropolystyrene, poly-α-methylstyrene, styrene-butadiene copolymer, styrene-vinyl chloride copolymer, styrene-vinyl acetate copolymer, styrene-maleic acid copolymer, styrene-ester acrylate copolymer (such as styrene-methyl acrylate copolymer, styrene-ethyl acrylate copolymer, styrene-butyl acrylate copolymer, styrene-octyl acrylate copolymer, and styrene-phenyl acrylate copolymer), styrene-ester methacrylate copolymers (such as styrene-methyl methacrylate copolymer, styrene-ethyl methacrylate copolymer, and styrene-phenyl methacrylate copolymer), styrene-α-chloracryate methyl copolymer, and styrene-acrylonitrile acrylate ester copolymer, methyl methacrylate resin, butyl methacrylate resin, ethyl acrylate resin, butyl acrylate resin, modified acrylic resins (such as silicone-modified acrylic resin, vinyl-chloride-modified acrylic resin, and acrylic urethane resin), vinyl chloride resin, styrene-vinyl acetate copolymer, vinyl chloride-vinyl acetate copolymer, rosin-modified maleic acid resin, phenol resin, epoxy resin, polyester resin, polyester polyurethane resin, polyethylene, polypropylene, polybutadiene, polyvinylidene chloride, ionomer resin, polyurethane resin, silicone resin, ketone resin, ethylene-ethyl acrylate copolymer, xylene resin, polyvinyl butyral resin, polyamide resin, modified polyphenylene oxide resin.

To prevent overstretching of the elastic layer made of a rubber material that easily stretches, a core layer made of a material such as canvas may be provided between the base layer and the elastic layer. One or more materials selected from the following materials can be used. These materials include, but are not limited to, natural fibers such as cotton and silk, synthetic fibers such as polyester fiber, nylon fiber, acrylic fiber, polyolefin fiber, polyvinyl alcohol fiber, polyvinyl chloride fiber, polyvinylidene chloride fiber, polyurethane fiber, polyacetal fiber, polyfluoroethylene fiber, and phenol fiber, carbon fiber, inorganic fiber such as glass fiber, and metal fibers such as iron fiber and copper fiber. These materials can be in a form of yarn or woven cloth. The yarn may consist of one filament or two or more filaments twisted together, a single-twist yarn, a plied yarn, and two-folded yarn, or any other suitable yarns. For example, fibers made of materials selected from the above material group may be mixed and spun. The yarn may be subjected to an appropriate conducting process. The woven cloth may be made by any weaving methods such as tricot weaving. Alternatively, the woven cloth may be made by combined weaving, and may be subjected to a conducting process.

The surface coating layer of the intermediate transfer belt 31 is a smooth layer that covers the surface of the elastic layer. Any material can be used for the coating layer. However, materials that can enhance the transferability of the secondary transfer through reducing the adhesion force of the toner onto the surface of the intermediate transfer belt 31 are generally used. For example, the surface coating layer may be comprised of one or more of polyurethane, polyester, or an epoxy resin, in which fine particles of one or more of lubricating materials such as fluorine-containing resins, fluorine-containing compounds, carbon fluoride, titanium oxide, and silicon carbide are dispersed. Such lubricating materials can reduce surface energy of the layer. The fine particles may have variety of particle diameters. The surface coating layer may also be a fluorine-containing layer formed by thermally treating a fluorine-containing rubber, thereby reducing surface energy of the layer.

Each of the base layer, elastic layer, and surface coating layer may include a resistivity controlling agent such as carbon black, graphite, a metal powder (for example, aluminum and nickel), and a conductive metal oxide (for example, tin oxide, titanium oxide, antimony oxide, indium oxide, potassium titanate, antimony-tin composite oxide (ATO)). The conductive metal oxides may be covered with an insulative fine particles such as barium sulfate, magnesium silicate, or calcium carbonate, for example. These materials are not limited thereto.

A lubricant may be applied to the surface of the intermediate transfer belt 31 to protect the surface of the intermediate transfer belt 31. In such a case, a lubricant coating device includes a solid lubricant such as a zinc stearate lump, and an application device such as a brush roller that contacts and scrapes off the solid lubricant while rotating to apply the thus-obtained lubricant powder onto the surface of the intermediate transfer belt 31. Depending on the material of the toner and the intermediate transfer belt 31, and the surface friction coefficient or the like of the intermediate transfer belt 31, the lubricant may not be necessary.

Next, with reference to FIGS. 4 through 6, a description is provided of experiments performed by the present inventors.

In the experiments, a test machine having the same configurations as the image forming apparatus shown in FIG. 1 was used, and images were output onto paper having a coarse surface and paper with a smooth surface in print tests. In the print tests, a 100 kg-typer, a 175 kg-type, and a 260 kg-type Leathac (registered trademark) paper were used as the paper having a coarse surface. A 79.1 gsm-type Top-coat paper was used as the paper having a smooth surface. As the intermediate transfer belt 31, an elastic belt including an elastic layer as in the above embodiment and a single-layer belt (PI belt) made of polyimide (PI) without the elastic layer were used. Two types of images, i.e., a black solid image and a two-dot image, were formed to evaluate the density reproducibility on the coarse-surface paper and the dot reproducibility (image reproducibility) on the smooth-surface paper. FIG. 4 is a table showing parameters for the experiments.

FIG. 5 is a table showing evaluation parameters of density reproducibility at a recessed portion.

FIG. 6 is a table showing requirements for grades of density reproducibility at the recessed portion.

The density reproducibility at the recessed portion was evaluated as follows. When toner is transferred adequately to the recessed portion of the recording sheet so that adequate image density was obtained at the recessed portion, it was graded as "5". When an area having white spots (i.e., missing toner) in the recessed portion was small or the image density at the recessed portion was slightly lower than the smooth portion of the recording medium, it was graded as "4". When the area having white spots was relatively large or the image density was significantly low, it was graded as "3". When the area having white spots was greater than the area of grade 3 or the image density is significantly lower than the image density of grade 3, it is graded as "2". When the entire recessed portion is white and hence the recessed portion is easily recognized or even worse, it is graded as "1". Grade 4 and above are acceptable image quality.

FIG. 7 is a table showing evaluation parameters of dot reproducibility.

Figures 8, 9:
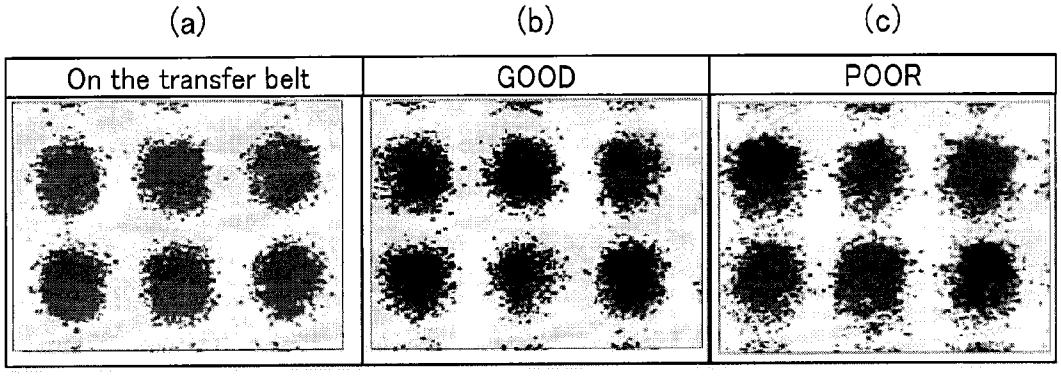
FIG. 8 (*a*) shows an enlarged image of an intermediate transfer belt observed with a microscope.
FIG. 9 is a table showing results of the experiments.

The dot reproducibility was evaluated as follows. An unfixed dot image on the smooth sheet and the dot image on the intermediate transfer belt 31 were observed using a microscope to compare the dot shapes. When the dot shape on the smooth sheet had substantially the same shape as the dot shape on the intermediate transfer belt 31, it was evaluated as "GOOD". When the dot shape on the smooth sheet is more irregular than the dot shape on the intermediate transfer belt 31 so that the dots were connected, it was graded as "POOR". FIG. 8 (*a*) shows an image captured on the intermediate transfer belt 31. FIG. 8 (*b*) shows an unfixed dot image captured on the smooth sheet evaluated as "GOOD", and FIG. 8 (*c*) shows an unfixed dot image captured on the smooth sheet evaluated as "POOR". All the images were captured using the microscope.

FIG. 9 is a table showing results of the experiments.

As shown in FIG. 9, when the PI belt (non-elastic belt) was used as the intermediate transfer belt 31, sufficient density reproducibility was not obtained at the recessed portion on any of the paper with the coarse surface. Even when the elastic belt was used as the intermediate transfer belt 31, to obtain sufficient density reproducibility at the recessed portion on the 260 kg-type Leathac paper, a relatively high pressing force, i.e., approximately 240 [N], was required for the nip forming roller (secondary transfer roller) 36 against the intermediate transfer belt 31. By contrast, when using the elastic belt as the intermediate transfer belt 31, when the transfer pressing force was 120 [N] or above, dot reproducibility on the smooth paper was not sufficiently obtained.

As can be understood from the evaluation results, in order to make both the density reproducibility on the paper having a coarse surface and the dot reproducibility on the paper having a smooth surface when using the elastic belt, the transfer pressing force needs to be switched between, for example, approximately 60 [N] and approximately 240 [N] according to the sheet type (for example, depending on the difference in surface unevenness). Therefore, a pressing mechanism which can change the transfer pressing force in such a wide range is necessary.

Next, a description is provided of the pressing mechanism of the nip forming roller 36 according to the illustrative embodiment of the present disclosure.

In the known configuration using the pressing mechanism which employs, as an elastic member, a tension spring as a spring member to press both axial ends of the nip forming roller 36, when the transfer pressing force is switched between approximately 60 [N] and approximately 240 [N], the tension spring provided at one end of the nip forming roller 36 needs to switch the pressing force pressing the one end between approximately 30 [N] and approximately 120 [N]. In this case, for example, when pressing each end of the nip forming roller 36 with one tension spring, a pressing force of approximately 120 [N] is required for each tension spring. Therefore, in a case in which the spring constant is 1 N/mm, the tension spring, which can maintain elastic deformation without plastic deformation even when the degree of the extension/compression of the tension spring is in a relatively large range, i.e., approximately 120 mm, is necessary.

By contrast, when the degree of extension/compression of the tension spring that can maintain elastic deformation without plastic deformation is in the range of 10 mm, the spring constant necessary for the tension spring needs to have a large value of 12 [N/mm] at minimum. In this case, the sensitivity of the pressing force with respect to the tension of the tension spring is relatively high. Due to the deviation of the tension amount between the tension springs at both ends of the nip forming roller 36, variation in the transfer pressing force of the nip forming roller 36 in the axial direction is likely to be increased. Consequently, unevenness of image density in a sheet width direction (main scanning direction) is likely to be generated.

Figure 10:
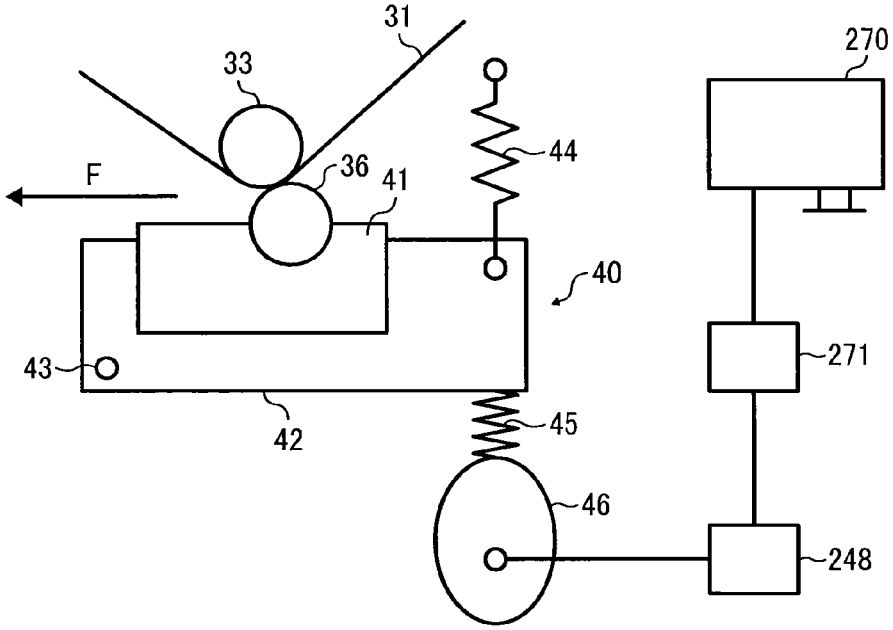
FIG. 10 is a schematic diagram illustrating a configuration of one end of a pressing device in an axial direction of a nip forming roller at a high secondary transfer nip pressure according to an illustrative embodiment of the present disclosure.

FIG. 10 is a schematic diagram illustrating a configuration of the nip forming roller at one end in the axial direction of a pressing device 40 according to the illustrative embodiment of the present disclosure. In FIG. 10, an arrow F indicates the direction of sheet conveyance.

The pressing device 40 applies, to the nip forming roller 36, the pressing force with which the nip forming roller 36 contacts the intermediate transfer belt 31 entrained about the secondary transfer back-surface roller 33. The pressing device 40 includes a retainer 42 which holds a transfer device case 41 rotatably supporting both ends of the rotational shaft of the nip forming roller 36. The retainer 42 is rotatable about a rotational shaft 43 parallel to the rotational shaft of the nip forming roller 36.

A portion of the retainer 42 substantially at the nip forming roller side corresponding to both ends of the nip forming roller 36 (the proximal side and the distal side in the drawing) relative to the rotational shaft side receives biasing forces from two elastic spring members, that is, a tension spring 44 and a compression spring 45, thereby producing a rotational force about the rotational shaft 43. Due to this rotational force, the nip forming roller 36 contacts the intermediate transfer belt 31 to produce the transfer nip pressure between the nip forming roller 36 and the intermediate transfer belt 31.

The tension spring 44 is disposed to pull the retainer 42 from above, and to allow a substantially constant biasing force to act on the retainer 42 at all times. On the other hand, the compression spring 45 is disposed to push up the retainer 42 from below, so that its lower end position can be shifted in the vertical or up-down direction according to the rotation angle of a cam 46. The cam 46 is rotationally driven by a rotation drive source 248 such as a motor. A controller 271 controls the rotation drive source 248 such that the rotation angle position at which the cam 46 is stopped can be switched.

As illustrated in FIG. 10, the image forming apparatus of the present illustrative embodiment includes a controller 271 and a recording sheet type obtaining device 270 such as a control panel. The recording sheet type obtaining device 270 obtains information on a type of recording sheet prior to image formation on the recording sheet. The controller 271 controls a nip pressure changing device of the transfer device to achieve a nip pressure suitable for the type of recording sheet based on the information on the type of recording sheet obtained by the recording sheet type obtaining device 270.

Figure 11:
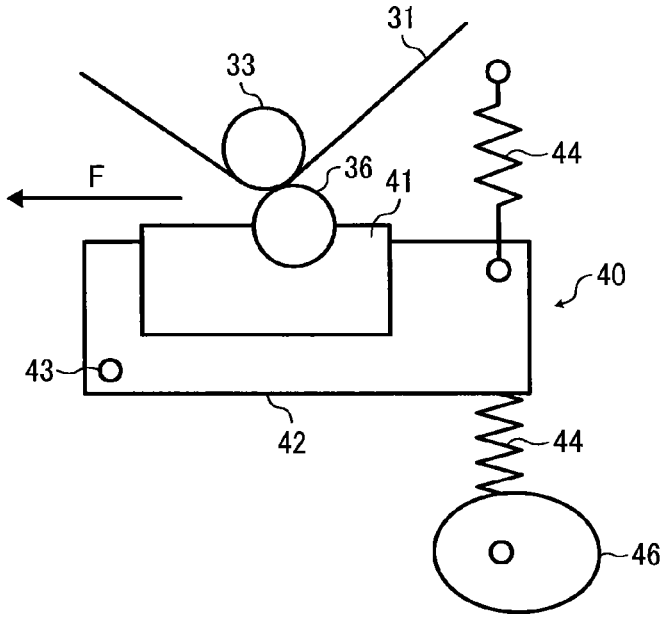
FIG. 11 is a schematic diagram illustrating a configuration of one end of the pressing device in the axial direction of the nip forming roller at a low secondary transfer nip pressure according to an illustrative embodiment of the present disclosure.

According to the present illustrative embodiment, the biasing force of one set of the tension spring 44 and the compression spring 45 provided at one end side of the nip forming roller 36 needs to change the pressing force at the one end between approximately 30 [N] and approximately 120 [N]. According to the present illustrative embodiment, due to the biasing force of the tension spring 44 the pressing force of 30 [N] is applied at all times. The compression spring 45 has a substantially natural length by stopping the cam 46 at the rotation angle position (second rotation angle) as shown in FIG. 11. At this time, the biasing force of the compression spring 45 hardly acts on the retainer 42 so that the pressing force at the one end side is 30 [N] caused by the biasing force of the tension spring 44 alone.

More specifically, in the present illustrative embodiment, the pressing force at the one end side when the cam 46 is stopped at the second rotation angle as shown in FIG. 11 is obtained only by the biasing force of the tension spring 44 having the change rate of the restoring force with respect to the unit compression amount or the unit tension amount lower than that of the compression spring 45. With this configuration, the target pressing force (i.e., 30 [N]) can be easily set, thereby obtaining easily the target transfer nip pressure.

By contrast, when the cam 46 is stopped at the rotation angle position (first rotation angle) as shown in FIG. 10, the compression spring 45 is compressed, thereby enabling the biasing force of the compression spring 45 to act on the retainer 42. At this time, due to the biasing force of the compression spring 45, the pressing force of approximately 90 [N] is applied. Therefore, the pressing force produced at the one end side is approximately 120 [N], which is obtained by adding the biasing force of 90 [N] due to the compression spring 45 to the biasing force of 30 [N] due to the tension spring 44. In the present illustrative embodiment, as the tension spring 44, a spring member, for example, having a spring constant of approximately 1.3 [N/m] can be used. As the compression spring 45, a spring member, for example, having a spring constant of approximately 2.6 [N/m] can be used.

According to the present illustrative embodiment, when an image is formed on a recording sheet having a coarse surface such as the Leathac paper, both cams 46 provided at both ends of the nip forming roller 36 are positioned at the first rotation angle shown in FIG. 10. With this configuration, the nip forming roller 36 can contact the intermediate transfer belt 31 at the transfer pressing force of approximately 240 [N], thereby achieving desired density reproducibility at the recessed portion and an image with fewer light and dark patches in accordance with the surface condition of the recording sheet.

When an image is formed on a recording sheet having a relatively smooth surface such as OK top-coat paper, both cams 46 provided at both ends of the nip forming roller 36 is positioned at the second rotation angle as shown in FIG. 11. With this configuration, the nip forming roller 36 can contact the intermediate transfer belt 31 at the transfer pressing force of approximately 60 [n], thereby achieving desired dot reproducibility.

Figure 12:
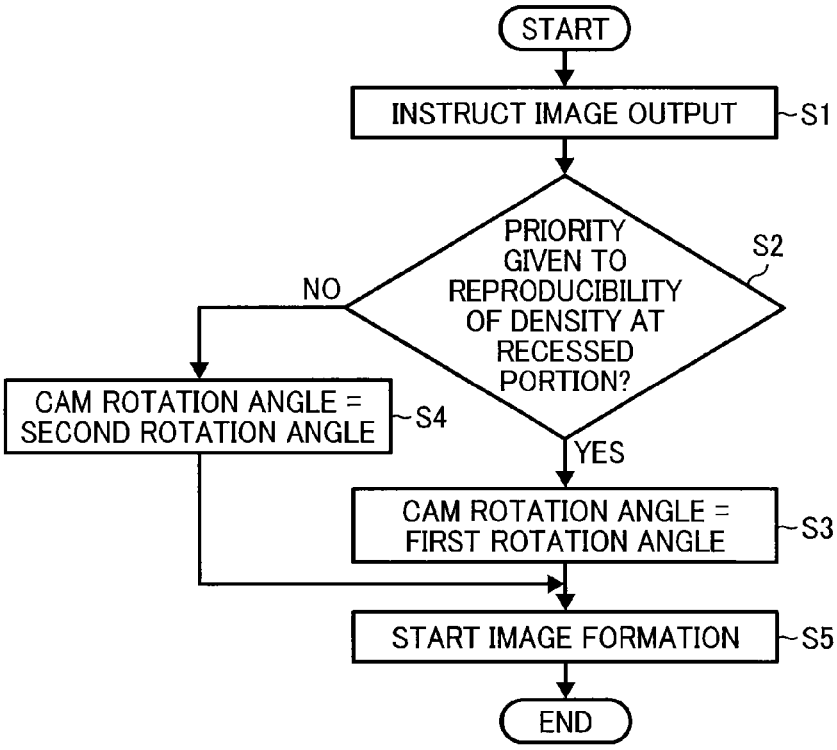
FIG. 12 is a flowchart showing steps of control for changing the secondary transfer nip pressure according to an illustrative embodiment of the present disclosure.

FIG. 12 is a flowchart showing steps of control for changing the secondary transfer nip pressure according to an illustrative embodiment of the present disclosure.

At step S1, and user operates the recording sheet type obtaining device 270, i.e., the control panel to instruct output of an image (S1). In this instruction, when the user instructs that the density reproducibility at the recessed portion is given priority (Yes, at step S2), the rotation drive source of the cams 46 is controlled such that the rotation angle position of the cams 46 of the pressing device 40 comes to the first rotation angle shown in FIG. 10 at step S3. Accordingly, the nip forming roller 36 contacts the intermediate transfer belt 31 at the transfer pressing force of approximately 240 [N], hence obtaining a high secondary transfer nip pressure. Thereafter, the image forming operation is started at step S5. With this configuration, the resulting output image has fewer light and dark patches associated with the surface conditions of the recording sheet even when the image is formed on the paper having a coarse surface such as Leathac paper.

By contrast, when the user instructs that the density reproducibility is not given priority upon instructing output of an Image (No, at step S2), the rotation drive source of the cams 46 is controlled such that the rotation angle position of the cams 46 of the pressing device 40 comes to the second rotation angle shown in FIG. 11 at step S4. Accordingly, the nip forming roller 36 contacts the intermediate transfer belt 31 at the transfer pressing force of approximately 60 [N], hence obtaining a low secondary transfer nip pressure. Subsequently, the image forming operation is started at step S5. With this configuration, the resulting output image on the paper having a smooth surface has high dot reproducibility.

In a case in which the user instructs the sheet type upon instructing output of an image, the density reproducibility at the recessed portion may be given priority when the sheet type is paper with a coarse surface (Yes, at step S2), and the density reproducibility at the recessed portion may not be given priority when the sheet type is the smooth paper (No, at step S2).

According to the present illustrative embodiment, the tension spring 44 and the compression spring 45 are used as the elastic members employed in the pressing device 40. This configuration provides greater freedom in the layout of the pressing device 40 as compared with the case in which both of the elastic members are the tension springs or the compression springs.

[Variation 1]

Figure 13:
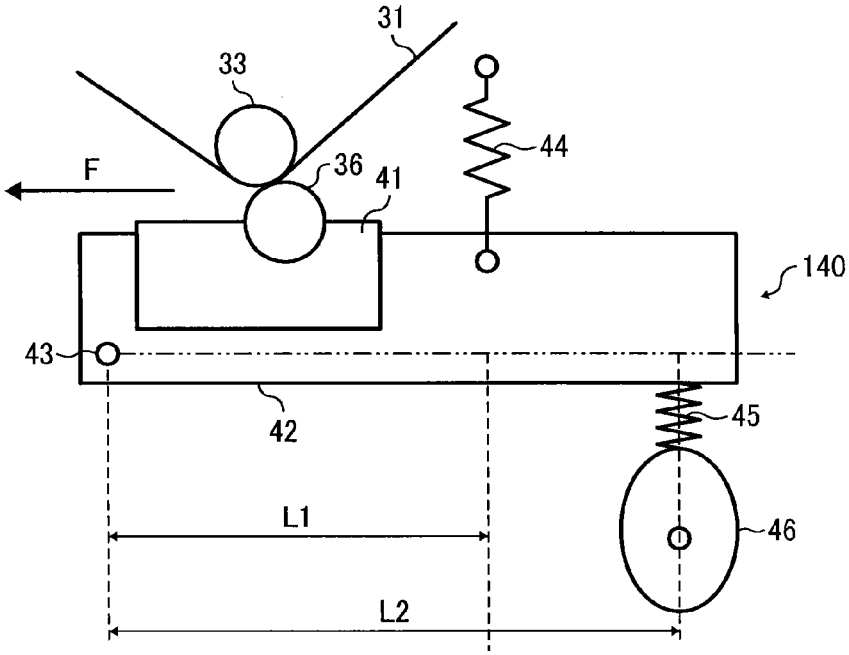
FIG. 13 is a schematic diagram illustrating a configuration of one end of the pressing device in the axial direction of the nip forming roller according to a first variation.

With reference to FIG. 13, a description is provided of a variation of the pressing device. FIG. 13 is a schematic diagram illustrating a configuration of one end of a pressing device 140 in the axial direction of the nip forming roller according to a first variation.

In the pressing device 40 of the foregoing embodiment, a distance L1 between a point of the retainer 42 on which the biasing force of the tension spring 44 acts and the rotational shaft 43 is substantially the same as a distance L2 between a point of the retainer 42 on which the biasing force of the compression spring 45 acts and the rotational shaft 43. By contrast, according to the variation 1, the distance L1 and the distance L2 are different. More specifically, in the variation 1, the compression spring 45 is moved away from the rotational shaft 43 to make the distance L2 longer than the distance L1, as compared with the configuration of the foregoing illustrative embodiment.

The pressing force applied by the pressing mechanism can be adjusted by adjusting the distances L1 and L2 in addition to the spring constant, the tension amount, and the compression amount of the tension spring 44 and the compression spring 45. As in the variation 1, when the distances L1 and L2 between the rotational shaft 43 and the tension spring 44 and the compression spring 45 are different, the pressing force of the tension spring 44 and the pressing force of the compression spring 45 can be individually adjusted as compared with the configuration in which the distances L1 and L2 are the same. This provides greater freedom in the adjustment of the pressing force.

More specifically, according to the variation 1, the distance L2 of the compression spring 45 whose biasing force is changed to change the secondary transfer nip pressure is longer than the distance L1 of the tension spring 44 which applies the substantially constant biasing force at all times. As the distance from the rotational shaft 43 is longer, a rate of change of the pressing force with respect to the change amount of the biasing force is increased. For the compression spring 45, a broader switching range of the secondary transfer nip pressure can be achieved with a smaller range of change in the compression amount. Therefore, the more appropriate compression spring 45 can be obtained relatively easily.

[Variation 2]

Figure 14:
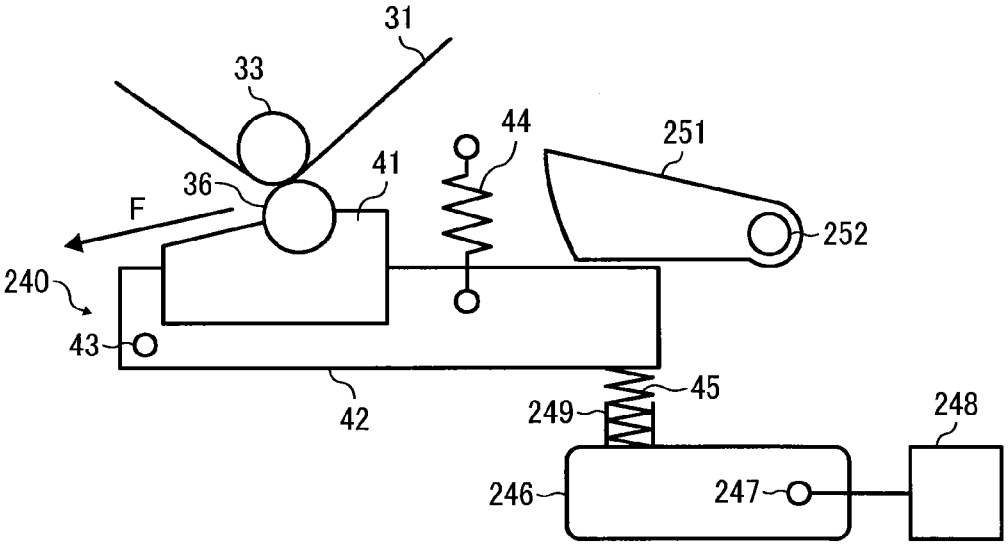
FIG. 14 is a schematic diagram illustrating a configuration of one end of the pressing device in the axial direction of the nip forming roller at the high secondary transfer nip pressure (i.e., a nip pressure changeable state) according to a second variation.

With reference to FIG. 14, a description is provided of a variation 2 of the pressing device. When fixing paper jams at the secondary transfer nip and/or upon attachment/detachment of the transfer unit 30 and the nip forming roller 36 to prevent the intermediate transfer belt 31 and the nip forming roller 36 from getting damaged and to make the maintenance operation easy, it is desired that the nip forming roller 36 be separated from the intermediate transfer belt 31 significantly. Therefore, when fixing the paper jams and/or upon maintenance operation, the retainer 42 needs to be rotated by a large amount about the rotational shaft 43 to the spaced position at which the nip forming roller 36 is greatly spaced from the intermediate transfer belt 31. However, in the pressing devices 40 and 140 according to the foregoing embodiment and the variation 1, the cam 46 which pushes up the lower end of the compression spring 45 disposed below the retainer 42 by the cam surface is used to change the biasing force of the compression spring 45. The cam 46 is in a rotational region through which the retainer 42 passes when the retainer 42 of the pressing devices 40 and 140 is rotated to the spaced position. As a result, the cam 46 prevents the pressing devices 40 and 140 from moving to the spaced position.

In the variation 2, the retainer 42 can be largely rotated about the rotational shaft 43 to the spaced position at which the nip forming roller 36 is spaced adequately from the intermediate transfer belt 31. A basic configuration of a pressing mechanism 240 according to the variation 2 is the same as that of the variation 1. Therefore, the description is provided only of the configuration different from the variation 1.

FIG. 14 is a schematic diagram illustrating a configuration of one end of a pressing device 240 in the axial direction of the nip forming roller 36 according to the variation 2.

According to the variation 2, the lower end position of the compression spring 45 disposed to push up the retainer 42 from below is movable in the vertical or up-down direction in accordance with the rotation angle of a pressure arm 246. The pressure arm 246 is driven to rotate about a rotational shaft 247 by a rotation drive source 248. The controller controls the rotation drive source 248 so as to change the rotation angle position at which the pressure arm 246 is stopped.

According to the variation 2, due to the biasing force of the tension spring 44 the pressing force of approximately 30 [n] is applied at all times. In a nip-pressure changing state in which the pressure arm 246 is stopped at the rotation angle position (first rotation angle) as shown in FIG. 14, the pressure arm 246 pushes up a stay 249 attached to the lower end of the compression spring 45 to compress the compression spring 45 so that the biasing force of the compression spring 45 acts on the retainer 42. Then, due to the biasing force of the compression spring 45 the pressing force of approximately 90 [N] is applied. Therefore, the pressing force produced at the one end side is approximately 120 [N], which is obtained by adding the biasing force of 90 [N] due to the compression spring 45 to the biasing force of 30 [N] due to the tension spring 44.

Figure 15:
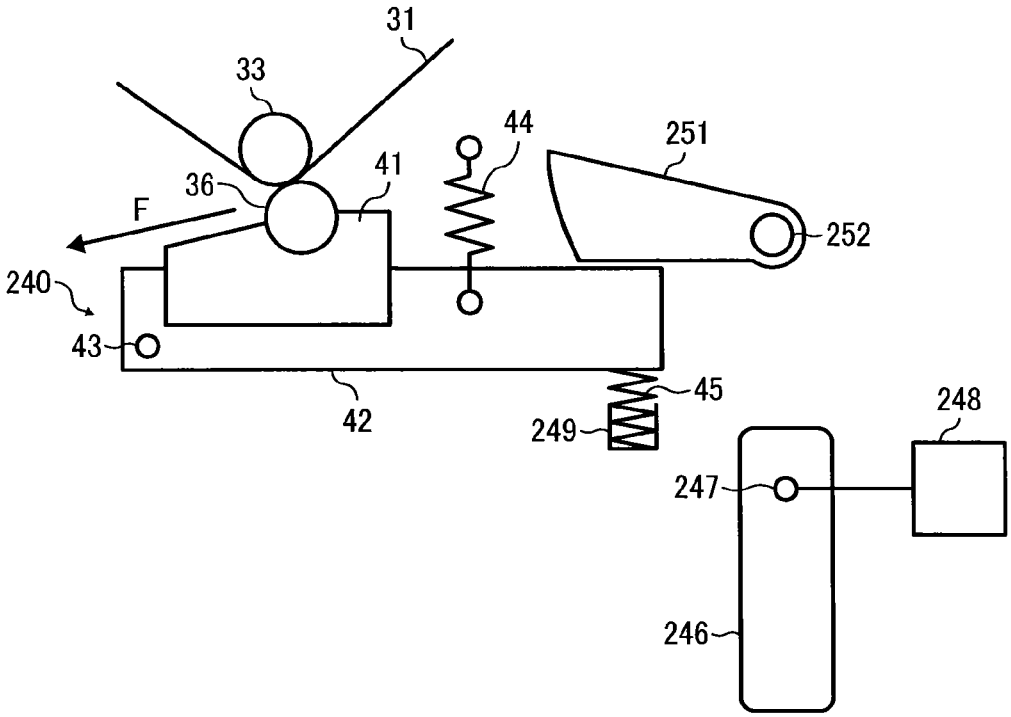
FIG. 15 is a schematic diagram illustrating a configuration of one end of the pressing device in the axial direction of the nip forming roller at the low secondary transfer nip pressure (i.e., a retracted state) according to an illustrative embodiment of the present disclosure.

By contrast, in the retracted state in which the pressure arm 246 is stopped at the rotation angle position (second rotation angle) as shown in FIG. 15, the pressure arm 246 is moved away from the stay 249 attached to the lower end of the compression spring 45, so that the compression amount of the compression spring 45 becomes zero (natural length). At this time, the biasing force of the compression spring 45 does not act on the retainer 42, so that the pressing force at the one end is 30 [N] due to the biasing force of the tension spring 44 alone.

According to the variation 2, when an image is formed on a recording sheet having a coarse surface such as the Leathac paper, both pressure arms 246 provided at both ends of the nip forming roller 36 are positioned at the first rotation angle shown in FIG. 14. With this configuration, the nip forming roller 36 can contact the intermediate transfer belt 31 at the transfer pressing force of approximately 240 [N], thereby achieving desired density reproducibility at the recessed portion and an image with fewer light and dark patches in accordance with the surface condition of the recording sheet. When an image is formed on a recording sheet having a relatively smooth surface such as the OK top-coat paper, both pressing arms 246 provided at both ends of the nip forming roller 36 is positioned at the second rotation angle as shown in FIG. 15. With this configuration, the nip forming roller 36 can contact the intermediate transfer belt 31 at the transfer pressing force of approximately 60 [N], thereby achieving desired dot reproducibility.

According to the variation 2, an arm 251 is provided as a moving device which moves the nip forming roller 36 from a contact position at which the nip forming roller 36 contacts the surface of the intermediate transfer belt 31 to a separated position at which the nip forming roller 36 is separated from the surface of the intermediate transfer belt 31. The arm 251 is rotatable about a rotational shaft 252 in conjunction with the movement of a lever. With this configuration, with the operation of the lever, the arm 251 can switch the rotation angle position at which the arm 251 is stopped.

Figure 16:
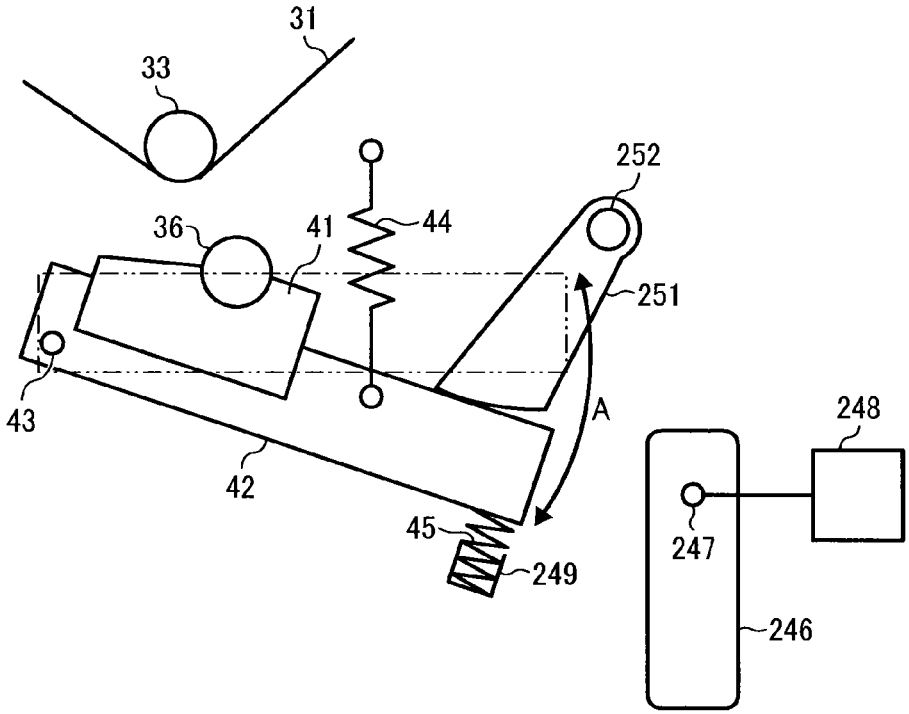
FIG. 16 is a schematic diagram illustrating a configuration of one end of the pressing device in the axial direction of the nip forming roller when the nip forming roller is located in a separated position.

The arm 251 is disposed such that its free end is located above the upper surface of the retainer 42. As shown in FIGS. 14 and 15, at the time of the image forming operation, the arm 251 is stopped at the position at which the free end portion of the arm 251 does not push down the retainer 42. At this time, the nip forming roller 36 is situated at the contact position at which the nip forming roller 36 contacts the intermediate transfer belt 31. By contrast, when fixing paper jams and upon maintenance, a technician operates the lever so that the arm 251 moves to the position shown in FIG. 16. At this time, the free end portion of the arm 251 contacts the upper surface of the retainer 42 to push down the retainer 42 against the biasing force of the tension spring 44. Consequently, the retainer 42 is rotated about the rotational shaft 43, and the nip forming roller 36 separates from the intermediate transfer belt 31 as shown in FIG. 16.

According to the variation 2, as described above, when the nip forming roller 36 is moved from the contact position to the separated position by operating the lever, the arm 246 is retracted. When the pressure arm 246 is retracted, the pressure arm 246 is outside the rotational range (moving path) of the retainer 42 rotated about the rotational shaft 43 by the arm 251 in conjunction with the movement of the lever. Here, the rotational range of the retainer 42 refers to a space through which the retainer 42 passes when the retainer 42 is rotated in the rotational range indicated by a double-headed arrow A in FIG. 16. Therefore, the pressure arm 246 does not hinder the nip forming roller 36 from moving from the contact position to the separated position.

Figure 17:
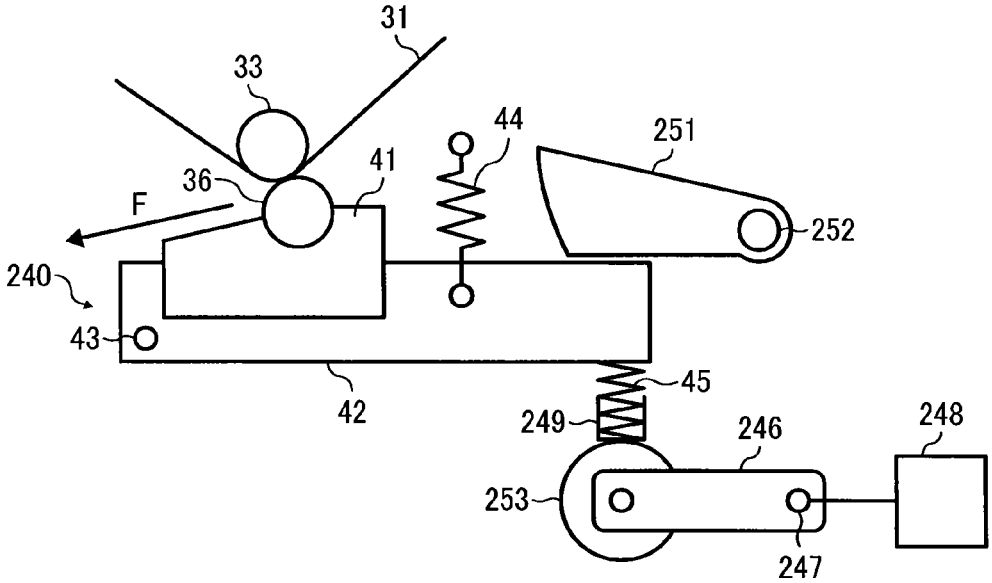
FIG. 17 is schematic diagram illustrating another example of the pressing device of the second variation.

According to the variation 2, the pressure arm 246 is directly brought into contact with and moved away from the stay 249 attached to the lower end of the compression spring 45. Alternatively, as shown in FIG. 17, a ball bearing 253 may be provided at a contact portion at which the pressure arm 246 and the stay 249 come into contact with each other. In this case, sliding friction at the contact portion at which the pressure arm 246 and the stay 249 contact is reduced, thereby reducing less rubbing noise. Because this configuration reduces the friction of the contact portion of the pressure arm 246 and the stay 249, wear or abrasion of the pressure arm 246 and the stay 249 can be prevented even after extended use. Therefore, the compression amount of the compression spring 45 can be stably and reliably maintained over time, hence stabilizing image quality.

Figure 18:
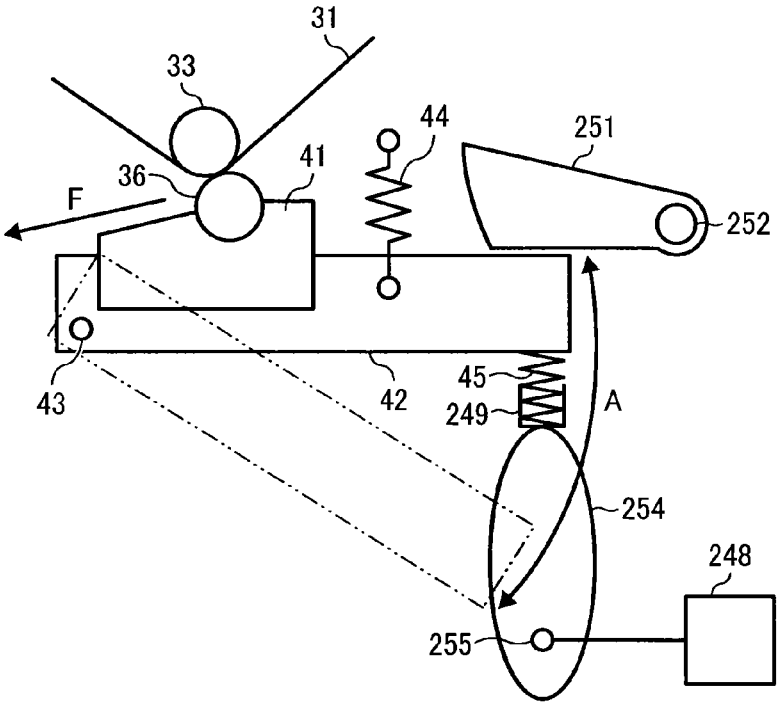
FIG. 18 is a schematic diagram illustrating still another example of the pressing device of the second variation at the high secondary transfer nip pressure (nip pressure changeable state)
Figure 19:
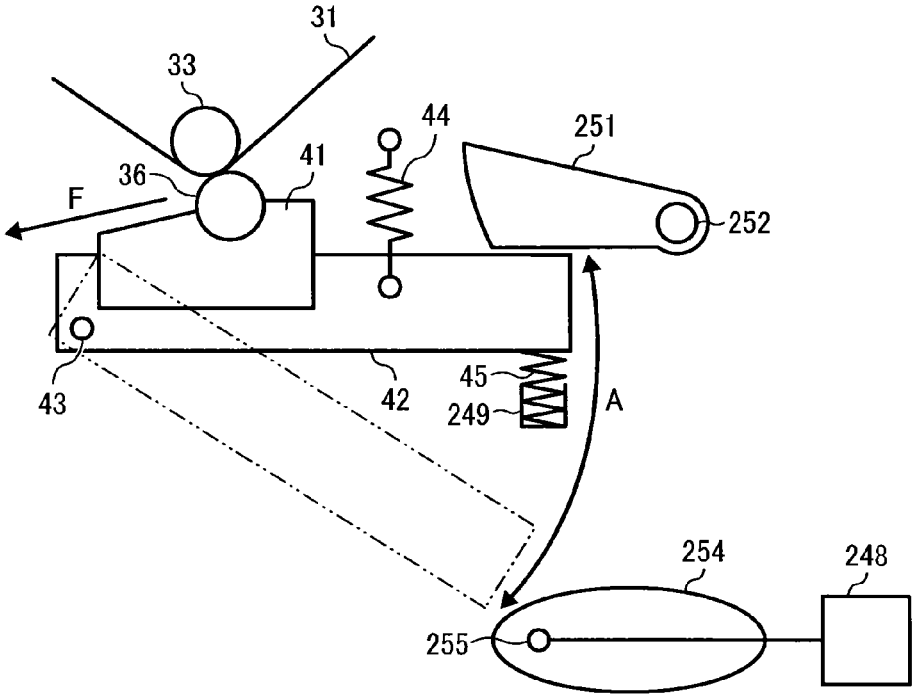
FIG. 19 is a schematic diagram illustrating the pressing device of FIG. 18 at the low secondary transfer nip pressure (retracted state)

A shown in FIGS. 18 and 19, in place of the pressure arm 246 described above, a pressure cam 254 may be used. More specifically, in the illustrated configuration, in the nip-pressure changing state in which the pressure cam 254 pushes up the stay 249 attached to the lower end of the compression spring 45, a rotational shaft 255 is disposed in a frontward position from an operation point at which the pressure cam 254 receives a force from the compression spring 45 (the contact portion at which the pressure cam 254 and the stay 249 contact) in the direction of the force. Therefore, even when the pressure cam 254 receives the force from the compression spring 45, rotation moment is hardly generated in the pressure cam 254. Accordingly, torque necessary for maintaining the pressure cam 254 in the nip-pressure changing state is small, so that its maintenance is easy.

According to the variation 2, when the pressure arm 246 is brought into the nip-pressure changing state, the compression spring 45 is compressed so that the biasing force of the compression spring 45 acts on the retainer 42, and when the pressure arm 246 is brought into the retracted state, the compression of the compression spring 45 is released so that the biasing force of the compression spring 45 hardly acts on the retainer 42. Therefore, the operation of switching the pressure arm 246 between the nip-pressure changing state and the retracted state serves as the switching operation of whether or not to allow the biasing force of the compression spring 45 to act on the retainer 42.

Figure 21:
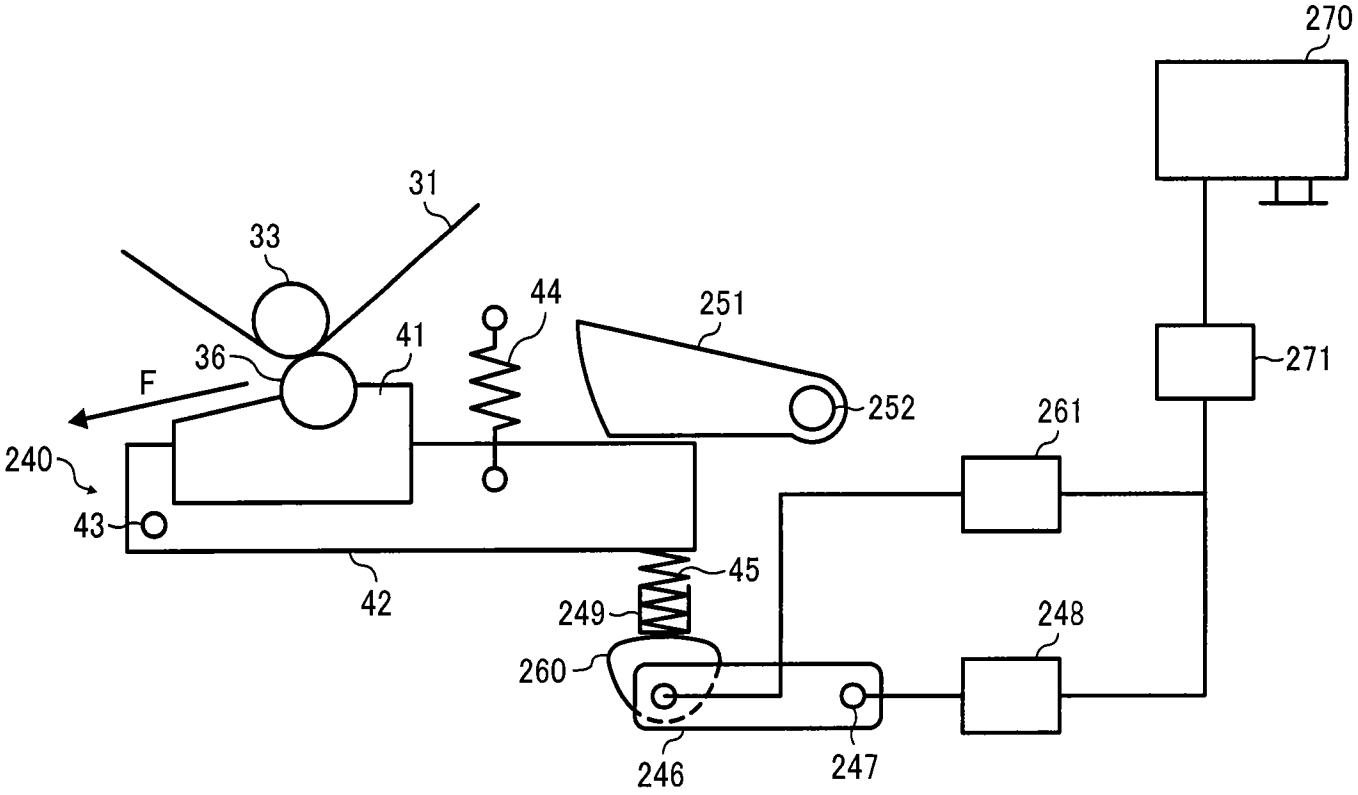
FIG. 21 is a schematic diagram illustrating a variation of the pressing device shown in FIG. 17.

Alternatively, these operations may be different operations. That is, a device that can compress and release the compression spring 45 when the pressure arm 246 is in the nip pressure changeable state may be provided additionally. For example, as illustrated in FIG. 21, a device that changes the compression amount of the compression spring 45 such as a cam 260 is provided at the distal end portion of the pressure arm 246 that contacts the stay 249 of the compression spring 45. The cam 260 is rotationally driven by a rotation drive source 261. The cam 260 can change the compression amount of the compression spring 45. More specifically, the cam 260 can compress the compression spring 45 and releases the compression thereof when the pressure arm 246 is in the nip pressure changeable state.

Figure 20:
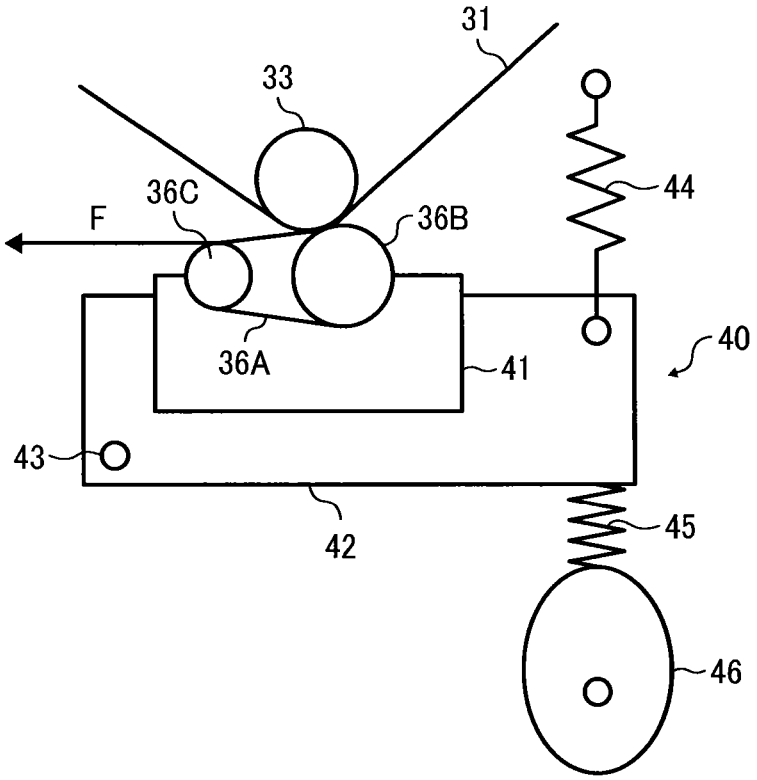
FIG. 20 is a schematic diagram illustrating a variation of a nip forming member.

As shown in FIG. 20, according to the embodiment and the variations 1 and 2, a belt-type nip forming member (secondary transfer belt) 36A may be used in place of the nip forming roller 36. The nip forming belt 36A is supported by a plurality of rollers 36B and 36C, and can be driven counterclockwise in FIG. 20. The nip forming belt 36A is disposed outside the loop of the intermediate transfer belt 31, and sandwiches the intermediate transfer belt 31 between the nip forming belt 36A and the secondary transfer back-surface roller 33 disposed inside the loop, thereby, forming the secondary transfer nip at which the front surface of the intermediate transfer belt 31 and the front surface of the nip forming belt 36A contact. The above-described image forming apparatus is an example of the image forming apparatus. The present disclosure includes the following embodiments.

(Aspect A)

A transfer device includes a nip forming member such as the nip forming roller 36 to contact a surface of an image bearing member such as the intermediate transfer belt 31 to form a transfer nip such as a secondary transfer nip, the pressing devices 40 and 140 to produce a contact pressure between the nip forming member and the image bearing member according to a restoring force when an elastic member is elastically deformed, and a nip pressure changing unit such as the cams 46 and 254 and the pressure arm 246 to change the elastic deformation amount of the elastic member between at least two stages to change the nip pressure of the transfer nip, wherein each of the pressing devices has a plurality of elastic members such as the tension spring 44 and the compression spring 45, and while one of the elastic members (tension spring 44) produces the contact pressure the nip pressure changing unit changes the elastic deformation amount (compression amount) of the different elastic member (compression spring 45).

Accordingly, the transfer nip pressure can be changed while obtaining stably the target transfer nip pressure by using the elastic member having a relatively narrow elastic deformation range. Preferably, the nip pressure changing device changes the nip pressure of the transfer nip by changing the elastic deformation amount (compression amount) of the different elastic member (compression spring 45) while maintaining the elastic deformation amount (tension amount) of one of the elastic members (tension spring 44).

(Aspect B)

In the aspect A, the nip pressure changing device switches the elastic deformation amount of the different elastic member between a first state in which the contact pressure by the different elastic member is not produced and a second state in which the contact pressure by the elastic deformation of the different elastic member is produced. Accordingly, the control of the elastic deformation amount of the different elastic member is easy.

(Aspect C)

In the aspect A or B, the modulus of elasticity (spring constant) of the different elastic member (compression spring 45) is greater than the modulus of elasticity (spring constant) of the one elastic member (tension spring 44). Accordingly, the transfer nip pressure can be changed more greatly.

(Aspect D)

According to any one of the aspects A to C, the pressing device 140 allows the restoring force of the plurality of elastic members to act in the direction of rotating a support member such as the retainer 42 supporting the nip forming member about the predetermined rotational shaft 43 to produce the contact pressure between the nip forming member and the image bearing member, and the distance L1 between the rotational shaft 43 and the point on the supporting member on which the restoring force of the one elastic member (tension spring 44) acts is different from the distance L2 between the rotational shaft 43 and the point on the supporting member on which the restoring force of the different elastic member (compression spring 45) acts.

Accordingly, as described in the variation 1, the degree of freedom in adjustment of the pressing force can be increased.

(Aspect E)

In the aspect D, the modulus of elasticity (spring constant) of the different elastic member (compression spring 45) is greater than the modulus of elasticity (spring constant) of the one elastic member (tension spring 44), and the distance L1 between the rotational shaft and the point on the supporting member on which the restoring force of the one elastic member acts is shorter than the distance L2 between the rotational shaft and the point on the supporting member on which the restoring force of the different elastic member acts.

Accordingly, as described in the variation 1, for the different elastic member, the more appropriate elastic member can be obtained relatively easily.

(Aspect F)

In any one of the aspects A to E, at least one of the elastic members is a compression spring or a tension spring. Accordingly, the modulus of elasticity (spring constant) in a relatively wide range can be easily selected, and the relatively wide elastic deformation range can be easily selected. Therefore, the more appropriate elastic member can be obtained relatively easily.

(Aspect G)

In the aspect F, one of the one elastic member and the different elastic member is the tension spring, and the other is the compression spring. Accordingly, the one elastic member and the different elastic member can be easily disposed in different positions, and the degree of freedom in the layout of the pressing device can be obtained as compared with the case in which the one elastic member and the different elastic member are both the tension springs or the compression springs.

(Aspect H)

In any one of the aspects A to the transfer device includes a moving device such as the arm 251 to move the nip forming member from a contact position at which the nip forming member contacts the surface of the image bearing member to a separated position at which the nip forming member is separated from the surface of the image bearing member, and a state switching unit such as the rotation drive source 248 to change the state of the nip pressure changing device between a nip pressure changeable state capable of changing the nip pressure of the transfer nip and a retracted state which does not hinder the nip forming member from moving from the contact position to the separated position by the moving device.

Accordingly, the nip pressure changing device can be brought into the retracted state so as not to become an obstacle when the nip forming member is moved by the moving device from the contact position to the separated position at the time of fixing paper jams and the maintenance process.

(Aspect I)

In any one of the aspects A to G, the transfer device includes a moving device such as the arm 251 to move the nip forming member from a contact position at which the nip forming member contacts the surface of the image bearing member to a separated position at which the nip forming member is spaced from the surface of the image bearing member, and a state switching device such as the rotation drive source 248 to switch the state of the nip pressure changing device between a nip-pressure changing state which changes the nip pressure of the transfer nip and a retracted state which does not hinder the nip forming member from moving from the contact position to the separated position by the moving device.

Accordingly, the nip pressure changing device can be brought into the retracted state so as not to be an obstacle when the nip forming member is moved by the moving device from the contact position to the separated position at the time of paper jams and the maintenance.

(Aspect J)

In the aspect H or I, the pressing device allows the restoring force of the plurality of elastic members to act in the direction of rotating a support member that supports the nip forming member about a predetermined rotational shaft to produce the contact pressure between the nip forming member and the image bearing member. The moving device rotates the support member about the predetermined rotational shaft to move the nip forming member from the contact position to the separated position. The state switching device positions the nip pressure changing device in the moving path of the support member by the moving device to bring the nip pressure changing device into the nip pressure changeable state or the nip-pressure changing state, and positions the nip pressure changing device outside the moving path of the support member by the moving device to bring the nip pressure changing device into the retracted state.

Accordingly, the state of the nip pressure changing device can be easily switched between the nip-pressure changeable state or the nip-pressure changing state and the retracted state.

(Aspect K)

An image forming apparatus which forms an image formed on the surface of an image bearing member on a recording sheet by using a transfer device to transfer the image onto the recording sheet ultimately employs the transfer device according to any one of the aspects A to J.

Accordingly, the target transfer nip pressure can be stably obtained by using an elastic member having a relatively narrow elastic deformation range, and the transfer nip pressure can be greatly changed according to the image forming conditions.

(Aspect L)

In the aspect K, the image forming apparatus includes a recording sheet type obtaining device such as a control panel and a controller that obtains the type of a recording sheet, and a controller to control the nip pressure changing device of the transfer device to provide a nip pressure corresponding to the type of the recording sheet obtained by the recording sheet type obtaining device before an image is formed on the recording sheet.

Accordingly, an image can be formed by using the appropriate transfer nip pressure according to the type of the recording sheet, hence forming a satisfactory image on a wide variety of recording sheets.

(Aspect M)

In the aspect L, the controller controls the nip pressure changing device such that when forming an image on a recording sheet such as a smooth sheet with low surface roughness, the elastic deformation amount of the different elastic member is reduced or eliminated while the contact pressure due to the one elastic member is produced, and when forming an image on a recording sheet with a coarse surface with high surface roughness, the elastic deformation amount of the different elastic member is increased while the contact pressure due to the one elastic member is produced.

Accordingly, an image can be formed on the recording sheet with high surface roughness by switching the transfer nip pressure to a high transfer nip pressure, thereby forming an image with fewer patterns of light and dark patches in accordance with the surface conditions of the recording sheet. Furthermore, an image can be formed on the smooth recording sheet by switching the transfer nip pressure to a low transfer nip pressure, thereby forming an image with high dot reproducibility.

(Aspect N)

In any one of the aspects K to M, the image bearing member is an intermediate transfer member such as the intermediate transfer belt 31 having a base layer and an elastic layer. Accordingly, a satisfactory image can be formed on the recording sheet with high surface roughness.

(Aspect O)

In any one of the aspects K to N, the image bearing member is a belt-shaped member. Accordingly, a satisfactory image can be formed on the recording sheet with high surface unevenness.

In the present disclosure, a transfer device includes a nip forming member to contact a surface of an image bearing member to form a transfer nip therebetween, a pressing device including a plurality of elastic members to produce a contact pressure between the nip forming member and the image bearing member according to a restoring force when the elastic member is elastically deformed, and a nip pressure changing device to change an elastic deformation amount of the elastic member at least two stages so as to change the nip pressure of the transfer nip.

While at least one of the plurality of elastic members keeps producing the contact pressure, the nip pressure changing device changes the nip pressure of the transfer nip by changing the elastic deformation amount of the different elastic member. It is to be noted that the "elastic member" herein includes a spring that produces a biasing force in proportion to a spring constant and a spring extension and contraction amount.

In the present disclosure, the pressing device includes the plurality of elastic members. While one of the plurality of elastic members produces the contact pressure, the elastic deformation amount of the different elastic member is changed to change the transfer nip pressure. Here, for example, a pressing force of the pressing device is changed from 30 [N] to 120 [N] to change the transfer nip pressure.

As in the known art, in the general configuration in which the elastic deformation amount of one elastic member is changed to change the transfer nip pressure, while the restoring force produced by the elastic deformation of the elastic member produces the pressing force of 30 [N], the elastic deformation amount of the elastic member is further increased to the pressing force of 120 [N]. In this configuration, the elastic member which can be elastically deformed with the pressing force in the range of from 0 [N] to 120 [N] is necessary.

On the contrary, according to the present disclosure, in a state in which all or a part of the pressing force of 30 [N] is obtained from the restoring force produced by the elastic deformation of at least one of the elastic members, the elastic deformation amount of the different elastic member is changed, thereby obtaining the pressing force of 120 [N] with the combination of the restoring force of the different elastic member and the restoring force of at least one of elastic members. At this time, the necessary elastic deformation range for at least one elastic member is in a range which can obtain the pressing force in a range of from 0 [N] to 30 [N] at the maximum.

The necessary elastic deformation range for the different elastic member is in a range which can obtain the pressing force in a range of from 0 [N] to a pressing force obtained by subtracting the pressing force covered by the one elastic member (30 [N] at the maximum) from 120 [N]. That is, the elastic deformation range required for the different elastic member whose elastic deformation amount is switched to change the transfer nip pressure can be narrower than the elastic deformation range required for the elastic member in the known configuration. As a result, the target transfer nip pressure can be stably obtained even when the transfer nip pressure is significantly changed by using the elastic member having a modulus of elasticity in the range limited to bring the sensitivity of the transfer nip pressure with respect to the elastic deformation amount of the elastic member into the proper range.

In the known configuration, when the target transfer nip pressure cannot be obtained with the restoring force of one elastic member, an elastic member set including two or more elastic members can be used to combine the restoring forces of the elastic members to obtain the target transfer nip pressure. However, when the transfer nip pressure is changed in such a known configuration, each of the elastic deformation amounts of the respective elastic members included in the elastic member set is changed at the same time and to the same level. As a result, the elastic member set serves as the function equivalent to one elastic member. Therefore, according to the present disclosure, with the use of the elastic member set as the different elastic member, the elastic deformation range required for the different elastic member (elastic member set) can be narrower than the elastic deformation range required for the elastic member set in the known configuration.

According to an aspect of this disclosure, the present invention is employed in the image forming apparatus. The image forming apparatus includes, but is not limited to, an electrophotographic image forming apparatus, a copier, a printer, a facsimile machine, and a digital multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, or system.

For example, any of the aforementioned methods may be embodied in the form of a system or device, including, but not limited to, any of the structure for performing the methodology illustrated in the drawings.

Each of the functions of the described embodiments may be implemented by one or more processing circuits. A processing circuit includes a programmed processor, as a processor includes a circuitry. A processing circuit also includes devices such as an application specific integrated circuit (ASIC) and conventional circuit components arranged to perform the recited functions.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. A transfer device, comprising:

a nip forming member to contact a surface of an image bearing member to form a transfer nip therebetween;

a pressing device comprising a plurality of elastic members, to produce a contact pressure between the nip forming member and the image bearing member according to a restoring force of at least one of the elastic members upon deformation of the elastic member; and a nip pressure changing device to change an amount of elastic deformation of the elastic member between at least two stages to change a nip pressure of the transfer nip, wherein while the contact pressure is produced by one of the elastic members, the nip pressure changing device changes the amount of elastic deformation of a different elastic member, different from the one elastic member that produces the contact pressure, to change the nip pressure of the transfer nip, and the nip pressure changing device switches the amount of elastic deformation of the different elastic member between a first state in which the contact pressure is not produced by the different elastic member and a second state in which the contact pressure is produced by the elastic deformation of the different elastic member.

2. The transfer device according to claim 1, wherein a modulus of elasticity of the different elastic member is greater than a modulus of elasticity of the one elastic member.

3. The transfer device according to claim 1, wherein the pressing device comprises a rotatable support member to support the nip forming member, and allows the restoring force of the plurality of elastic members to act in a direction of rotating the support member about a predetermined rotational shaft to produce the contact pressure between the nip forming member and the image bearing member, and a distance L1 between the rotational shaft and a point on the supporting member on which the restoring force of the one elastic member acts is different from a distance L2 between the rotational shaft and a point on the supporting member on which the restoring force of the different elastic member acts.

4. The transfer device according to claim 3, wherein the modulus of elasticity of the different elastic member is greater than the modulus of elasticity of the one elastic member, and the distance L1 is shorter than the distance L2.

5. The transfer device according to claim 1, wherein at least one of the elastic members is one of a compression spring and a tension spring.

6. The transfer device according to claim 5, wherein one of the one elastic member and the different elastic member is the tension spring, and the other is the compression spring.

7. The transfer device according to claim 1, further comprising:

a moving device to move the nip forming member from a contact position at which the nip forming member contacts the surface of the image bearing member to a separated position at which the nip forming member is separated from the surface of the image bearing member; and a state switching unit to change the state of the nip pressure changing device between a nip pressure changeable state capable of changing the nip pressure of the transfer nip and a retracted state which does not hinder the nip forming member from moving from the contact position to the separated position by the moving device.

8. The transfer device according to claim 7, wherein the pressing device comprises a rotatable support member to support the nip forming member, and allows the restoring force of the plurality of elastic members to act in a direction of rotating the support member about a predetermined rotational shaft to produce the contact pressure between the nip forming member and the image bearing member, the moving device moves the nip forming member from the contact position to the separated position by rotating the support member about the predetermined rotational shaft, and the state switching unit positions the nip pressure changing device within a moving path of the support member moved by the moving device to bring the nip pressure changing device into the nip pressure changeable state, and positions the nip pressure changing device outside the moving path of the support member moved by the moving device to bring the nip pressure changing device into the retracted state.

9. An image forming apparatus, comprising:

an image bearing member on which an image is formed; and the transfer device according to claim 1 to transfer the image formed on the image bearing member onto a recording material.

10. The image forming apparatus according to claim 9, further comprising:

a recording-material type obtaining device to obtain a type of the recording material; and a controller to control the nip pressure changing device of the transfer device to adjust the nip pressure to a nip pressure corresponding to the type of the recording material obtained by the recording-material type obtaining device before the image is formed on the recording material.

11. The image forming apparatus according to claim 10, wherein the controller controls the nip pressure changing device such that upon forming the image on a recording material with a smooth surface, the amount of elastic deformation of the different elastic member is reduced or eliminated while the contact pressure is produced by the one elastic member, and upon forming the image on a recording material with a coarse surface the amount of elastic deformation of the different elastic member is increased while the contact pressure is produced by the one elastic member.

12. The image forming apparatus according to claim 9, wherein the image bearing member is an intermediate transfer member comprising a base layer and an elastic layer.

13. The image bearing member according to claim 9, wherein the image bearing member is a belt-shaped member.

14. The transfer device according to claim 1, wherein the image bearing member is an intermediate transfer member comprising a base layer and an elastic layer.

15. The transfer device according to claim 1, wherein the image bearing member is a belt-shaped member.

16. The transfer device according to claim 1, wherein the nip pressure changing device comprises a cam.

17. The transfer device according to claim 1, wherein the nip pressure changing device comprises a pressure arm.

18. The transfer device according to claim 1, wherein the nip pressure changing device comprises a cam and a pressure arm.

19. The transfer device according to claim 7, wherein the moving device comprises an arm.

20. The transfer device according to claim 8, wherein the moving device comprises an arm.

21. A transfer device according to claim 1, wherein the nip pressure changing device comprises a pressure arm, the pressing device comprises a stay attached to one end of the different elastic member, in the first state, the pressure arm is not in contact with the stay such that the contact pressure is not produced by the different elastic member, and in the second state, the pressure arm pushes the stay such that the contact pressure is produced by the elastic deformation of the different elastic member.

22. The transfer device of claim 21, wherein the nip pressure changing device further comprises a ball bearing, and the ball bearing is positioned at a contact portion of the pressure arm and the stay, such that the ball bearing comes into contact with the stay in the second state.

23. A transfer device, comprising:

a nip forming member to contact a surface of an image bearing member to form a transfer nip therebetween;

a pressing device comprising a plurality of elastic members, to produce a contact pressure between the nip forming member and the image bearing member according to a restoring force of at least one of the elastic members upon deformation of the elastic member; and a nip pressure changing device to change an amount of elastic deformation of the elastic member between at least two stages to change a nip pressure of the transfer nip, wherein while the contact pressure is produced by one of the elastic members, the nip pressure changing device changes the amount of elastic deformation of a different elastic member, different from the one elastic member that produces the contact pressure, to change the nip pressure of the transfer nip, and a modulus of elasticity of the different elastic member is greater than a modulus of elasticity of the one elastic member.

24. The transfer device of claim 23, wherein the pressing device comprises a rotatable support member to support the nip forming member, and allows the restoring force of the plurality of elastic members to act in a direction of rotating the support member about a predetermined rotational shaft to produce the contact pressure between the nip forming member and the image bearing member, a distance L1 between the rotational shaft and a point on the supporting member on which the restoring force of the one elastic member acts is different from a distance L2 between the rotational shaft and a point on the supporting member on which the restoring force of the different elastic member acts, and the modulus of elasticity of the different elastic member is greater than the modulus of elasticity of the one elastic member, and the distance L1 is shorter than the distance L2.

25. A transfer device, comprising:

a nip forming member to contact a surface of an image bearing member to form a transfer nip therebetween;

a pressing device comprising a plurality of elastic members, to produce a contact pressure between the nip forming member and the image bearing member according to a restoring force of at least one of the elastic members upon deformation of the elastic member;

a nip pressure changing device to change an amount of elastic deformation of the elastic member between at least two stages to change a nip pressure of the transfer nip;

a moving device to move the nip forming member from a contact position at which the nip forming member contacts the surface of the image bearing member to a separated position at which the nip forming member is separated from the surface of the image bearing member; and a state switching unit to change the state of the nip pressure changing device between a nip pressure changeable state capable of changing the nip pressure of the transfer nip and a retracted state which does not hinder the nip forming member from moving from the contact position to the separated position by the moving device, wherein while the contact pressure is produced by one of the elastic members, the nip pressure changing device changes the amount of elastic deformation of a different elastic member, different from the one elastic member that produces the contact pressure, to change the nip pressure of the transfer nip.

26. The transfer device of claim 25, wherein the pressing device comprises a rotatable support member to support the nip forming member, and allows the restoring force of the plurality of elastic members to act in a direction of rotating the support member about a predetermined rotational shaft to produce the contact pressure between the nip forming member and the image bearing member, the moving device moves the nip forming member from the contact position to the separated position by rotating the support member about the predetermined rotational shaft, and the state switching unit positions the nip pressure changing device within a moving path of the support member moved by the moving device to bring the nip pressure changing device into the nip pressure changeable state, and positions the nip pressure changing device outside the moving path of the support member moved by the moving device to bring the nip pressure changing device into the retracted state.

* * * * *